US007371954B2

(12) United States Patent
Masuda et al.

(10) Patent No.: US 7,371,954 B2
(45) Date of Patent: May 13, 2008

(54) TUNER APPARATUS FOR AIDING A TUNING OF MUSICAL INSTRUMENT

(75) Inventors: Hideyuki Masuda, Hamamatsu (JP); Mari Yana, Meguro-ku (JP); Kenichi Miyazawa, Fukuroi (JP); Tsuyoshi Miyaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 183 days.

(21) Appl. No.: 11/195,241

(22) Filed: Aug. 2, 2005

(65) Prior Publication Data

US 2006/0027074 A1 Feb. 9, 2006

(30) Foreign Application Priority Data

Aug. 2, 2004 (JP) ..... 2004-225982
Aug. 2, 2004 (JP) ..... 2004-225983

(51) Int. Cl.
*G10G 7/02* (2006.01)

(52) U.S. Cl. ..... 84/454

(58) Field of Classification Search ..... None
See application file for complete search history.

(56) References Cited

U.S. PATENT DOCUMENTS 6,613,971 B1 * 9/2003 Carpenter ..... 84/454
6,627,806 B1 * 9/2003 Carpenter ..... 84/454
6,967,275 B2 * 11/2005 Ozick ..... 84/616
7,049,502 B2 * 5/2006 Taku et al. ..... 84/454
2004/0231496 A1 * 11/2004 Schwartz ..... 84/615
2005/0262989 A1 * 12/2005 Franblau ..... 84/470 R

FOREIGN PATENT DOCUMENTS

JP 9-257558 10/1997
JP 2001-202080 7/2001
JP 2002-132256 5/2002

* cited by examiner

*Primary Examiner*—Marlon T. Fletcher
(74) *Attorney, Agent, or Firm*—Pillsbury Winthrop Shaw Pittman LLP

(57) ABSTRACT

A tuner apparatus 10 causes a user to designate a musical instrument that is to be tuned and a reference pitch that is a standard upon tuning, by a process at a setting portion 110. A pitch detecting portion 130 detects a pitch of a performed note inputted via a microphone 20 and input portion 120. A target note specifying portion 140 defines a note name, which is positioned nearest to the performed note in a predetermined temperament (e.g., 12-note equal temperament), as a target note based upon the detected pitch of the performed note and the inputted reference pitch. Then, a calculating portion 150 calculates a difference between the pitch of the performed note and the pitch of the target note, and a display control portion 160 causes the display device 30 to display the calculated difference. Further, the display control portion 160 converts the target note into a note name written in a score relating to the musical instrument to be tuned by using a transposition parameter relating to the musical instrument to be tuned that is stored in the storage portion 100 and set by the setting portion 110, and causes the display device 30 to display a staff in which a note corresponding to the note name written in a score is written.

27 Claims, 11 Drawing Sheets

TUNER APPARATUS FOR AIDING A TUNING OF MUSICAL INSTRUMENT

BACKGROUND OF THE INVENTION

1. Field of the Invention

The present invention relates to a tuner apparatus for aiding a tuning of a musical instrument and a computer program applied to this apparatus.

2. Description of the Related Art

Various tuner apparatuses have conventionally been known as an apparatus for aiding a tuning of a musical instrument. For example, Japanese Unexamined Patent Application No. HEI09-257558 discloses a tuning apparatus wherein a difference between a frequency (hereinafter sometimes referred to as "pitch") of a performed note of a musical instrument to be tuned and a pitch of a reference note that is a standard upon the tuning are displayed by using a meter and the octave position of the reference note is displayed by using an LED that is associated with a keyboard of a piano. Further, Japanese Unexamined Patent Application No. 2002-132256 discloses a tuning apparatus wherein all pitch positions of notes that are in harmonic relation with a root (hereinafter sometimes referred to as "root") of a harmony are displayed by using an indicator for assisting a harmony lesson. The latter tuning apparatus is provided with a function for extracting a pitch of a performed note of various musical instruments, so that only one apparatus can perform a tuning of plural types of musical instruments.

However, among wind instruments and string instruments, there is the one (hereinafter referred to as "transposing instrument") in which a score is written with a key and tone range that are different from the actual performed note (hereinafter sometimes referred to as "actual tone pitch"). The former tuning apparatus is extremely difficult to use for a user of such transposing instrument. This is because the former tuning apparatus displays the octave position on the keyboard that is totally unrelated with the performance of the transposing instrument, and further, the transposition is not performed on the octave position.

In the latter tuning apparatus, upon performing a tuning in order to practice playing harmony, all pitch positions of notes in a certain interval that are in harmonic relation with the root which is a basis of the harmony are displayed, thereby entailing a problem that a user is difficult to grasp to which pitch position he/she should perform a tuning. Although the latter tuning apparatus can perform a tuning of plural types of musical instruments, a fine tuning cannot be performed according to a characteristic of each musical instrument, thereby entailing a problem that a high-precise tuning cannot be performed.

SUMMARY OF THE INVENTION

The present invention is accomplished in view of the above-mentioned problems, and aims to provide a technique capable of easily performing a tuning according to a type of a musical instrument that is to be tuned. The present invention further alms to provide a technique capable of easily performing a tuning according to a type of a musical instrument that is to be tuned and capable of performing a high-precise tuning.

In order to attain the aforesaid objects, a tuner apparatus according to the present invention has a setting portion that sets a transposition parameter indicating a relationship between a note name in an actual tone pitch and a note name written in a score of a performed note of a musical instrument to be tuned; an input portion for inputting the performed note of the musical instrument; a pitch detecting portion that detects a pitch of the inputted performed note; a calculating portion that calculates a difference between a pitch of a target note and the pitch detected by the pitch detecting portion; and a display control portion that causes a display device to display the difference calculated by the calculating portion, while converts the note name of the target note into the note name written in a score in accordance with the transposition parameter and causes the display device to display a staff in which a note corresponding to the converted note name written in a score is written.

According to the feature of the present invention, the pitch difference between the performed note of the musical instrument that is to be tuned and the target note is displayed on the display device, and the staff in which the note corresponding to the converted note name written in a score is written is displayed on the display device. As a result, the invention provides an effect that a tuning according to a type of a musical instrument to be tuned can easily be performed.

In this case, the display control portion may cause the display device to display the converted note name written in a score relating to the target note.

Further, the target note may be predetermined. And, the display control portion may cause the display device to display the difference calculated by the calculating portion, only when the difference is a value within a predetermined range.

Further, the setting portion may set a reference pitch indicating a pitch of a note that is a standard upon tuning the musical instrument, and the tuner apparatus may further be provided with a target note specifying portion for specifying the target note, that is positioned nearest to the performed note in a predetermined temperament, based upon the pitch detected by the pitch detecting portion and the reference pitch. Further, the setting portion may set a root, and the display control portion may convert the note name of the root into the note name written in a score in accordance with the transposition parameter and cause the display device to display the staff in which the note corresponding to the converted note name written in a score relating to the root is written. Moreover, the display control portion may cause the display device to display the converted note name written in a score relating to the root.

Further, the tuner apparatus is provided with an interval relationship specifying portion for specifying an interval relationship between the root and the target note, wherein the display control portion may cause the display device to display the interval relationship specified by the interval relationship specifying portion. Moreover, the calculating portion may calculate a difference between the pitch of the target note and the pitch detected by the pitch detecting portion, only when the specified interval relationship is a predetermined interval relationship. Further, the display control portion may cause the display device to display the difference calculated by the calculating portion, only when the specified interval relationship is a predetermined interval relationship.

Further, the tuner apparatus may be provided with a storage portion that stores the transposition parameter as associated with Identifiers each indicating a type of a musical instrument, wherein the setting portion may provide a user interface for causing a user to select the identifier of the musical instrument to be tuned among the Identifiers stored in the storage portion, and may read out the transposition parameter stored in the storage portion as associated with the identifier selected via the user interface, and the display control portion may convert the note name of the target note into the note name written in a score in accordance with the transposition parameter read out by the setting portion. Moreover, the storage portion stores, in addition to the transposition parameter, a score parameter indicating a clef written on the staff that is to be displayed by the display portion, as associated with the identifiers, wherein the setting portion may read out, in addition to the transposition parameter stored in the storage portion as associated with the identifier selected via the user interface, the score parameter stored in the storage portion as associated with the identifier, and the display control portion may write a note, corresponding to the note name of the target note written in a score, on the staff having the clef indicated by the score parameter set by the setting portion and display the resultant on the display device.

Further, in the tuner apparatus, the setting portion may cause a user to select which note name of the target note is displayed on the display device, the note name in the actual tone pitch or the note name written in a score, wherein the display control portion may cause the display device to display either one of a character string indicating the note name in the actual tone pitch or a character string indicating the note name written in a score, in accordance with the selection by the user.

Another feature of the present invention is that a tuner apparatus according to the present invention has a setting portion that sets a transposition parameter indicating a relationship between a note name in an actual tone pitch and a note name written in a score of a performed note of a musical instrument to be tuned, a reference pitch indicating a pitch of a note that is a standard upon tuning the musical instrument and a root; an input portion for inputting the performed note of the musical instrument; a pitch detecting portion that detects a pitch of the inputted performed note; a target note specifying portion for specifying a target note, that is positioned nearest to the performed note in a predetermined temperament, based upon the pitch detected by the pitch detecting portion and the reference pitch; an interval relationship specifying portion for specifying the interval relationship between the root and the target note; and a display control portion that causes a display device to display the interval relationship specified by the interval relationship specifying portion, while converts the note names of the root and the target note into the note names written in a score in accordance with the transposition parameter and causes the display device to display a staff in which notes corresponding to the converted note names of the root and the target note written in a score is written.

According to another feature of the present invention, the interval relationship in the predetermined temperament between the target note, that is positioned nearest to the actual tone pitch performed by the musical instrument to be tuned, and the root is displayed on the display device. Further, the note names of the root and the target note written in a score are displayed on the display device and the staff in which the notes corresponding to the note names are written is displayed on the display device. As a result, the invention provides an effect that a tuning according to a type of a musical instrument to be tuned can easily be performed.

In this case, the display control portion may cause the display device to display the converted note name of the target note written in a score.

Still another feature of the present invention is that a tuner apparatus is provided with a storage portion that stores, for every type of musical instrument, a pitch detecting parameter used upon detecting a pitch of a performed note of the musical instrument; a read-out portion that reads out the pitch detecting parameter according to the type of the musical instrument to be tuned; an input portion that inputs the performed note of the musical instrument; a pitch detecting portion that detects the pitch of the performed note considering the pitch detecting parameter; and a display control portion that causes a display device to display information relating to the pitch detected by the pitch detecting portion.

According to still another feature of the present invention, the pitch of the performed note of the musical instrument to be tuned is detected based upon the pitch detecting parameter determined beforehand for this musical instrument. As a result, the invention provides an effect that a tuning according to a type of a musical instrument to be tuned can easily be performed, and further, that a high-precise tuning can be performed.

In this case, the pitch detecting parameter includes a tone range parameter indicating a tone range of the corresponding musical instrument, and the pitch detecting portion may extract from the inputted performed note a frequency component included in the tone range indicated by the tone range parameter and may detect the pitch of the inputted performed note based upon the extracted frequency component. Further, the pitch detecting parameter may include a volume parameter indicating a threshold value relating to a volume of the corresponding musical instrument, and the pitch detecting portion may detect the pitch of the inputted performed note in case where the volume of the inputted performed note is greater than the threshold value indicated by the volume parameter. Moreover, the pitch detecting parameter may include a breath noise parameter indicating a breath noise of the corresponding musical instrument, wherein the pitch detecting portion may determine whether the inputted performed note is a breath noise or not based upon the breath noise parameter and may detect the inputted performed note in case where it determines that the inputted performed note is not a breath noise.

Further, upon embodying the present invention, the present invention is not limited to a tuner apparatus, but the invention can be embodied as a computer program and method applied to the tuner apparatus.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

A best mode for embodying the present invention will be explained hereinafter with reference to drawings.

A. First Embodiment

[A-1 Configuration]

Figure 1:
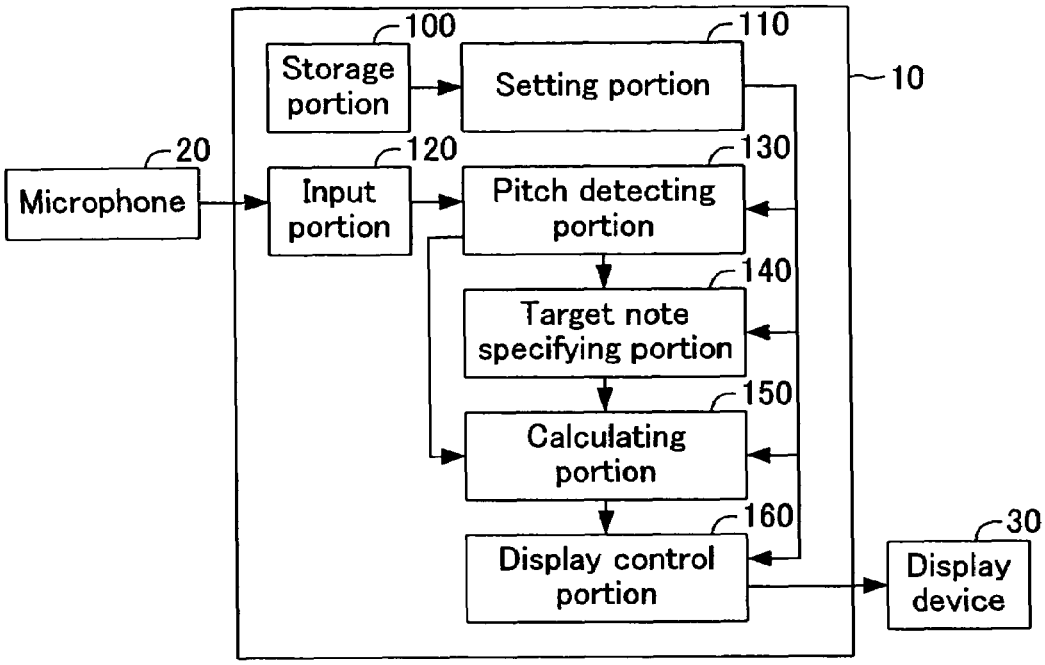
FIG. 1 is a view showing an example of a configuration of a tuner apparatus 10 according to a first embodiment of the present invention.

FIG. 1 is a view showing an example of a configuration of a tuner apparatus 10 according to a first embodiment of the present invention. As shown in FIG. 1, this tuner apparatus 10 has a storage portion 100, setting portion 110, input portion 120, pitch detecting portion 130, target note specifying portion 140, calculating portion 150 and display control portion 160. Connected to the input portion 120 is a microphone 20 for collecting performed notes of a musical instrument that is to be tuned. Connected to the display control portion 160 is a display device 30 such as a liquid crystal display device.

The storage portion 100 in FIG. 1 is, for example, a hard disk. It stores a transposition parameter, pitch detecting parameter and score parameter as associated with a musical instrument identifier (such as a character string indicating a type of a musical instrument) indicating a type of a musical instrument, those parameters relating to a musical instrument indicated by a musical instrument identifier. The transposition parameter is a parameter indicating a key or octave shift of the musical instrument with which this transposition parameter is associated. The pitch detecting parameter is a parameter utilized for detecting, by the pitch detecting portion 130, a pitch of a performed note of the musical instrument with which this pitch detecting parameter is associated. The score parameter is a parameter indicating a score usually utilized for the musical instrument with which the score parameter is associated. In this embodiment, the score parameter is a parameter indicating a clef (G clef or F clef) written in this score.

The setting portion 110 in FIG. 1 is for causing a user to conveniently set various parameters (aforesaid transposition parameter, pitch detecting parameter, score parameter or the like) to use the tuner apparatus 10. More specifically explained, the setting portion 110 causes the display device 30 to display a GUI (Graphical User Interface) screen shown in FIG. 2 by the later-described display control portion 160. The user visually recognizing the GUI screen shown in FIG. 2 appropriately operates an operating portion (not shown) such as a ten-key or mouse provided at the tuner apparatus 10, whereby the user can select the musical instrument Identifier of the musical instrument to be tuned by a pull-down menu 200 shown in FIG. 2 or can input to an area 230 shown in FIG. 2 a numeric character string indicating a pitch of a reference note (hereinafter referred to as "reference pitch") that is a reference upon tuning the musical instrument.

When the musical instrument identifier is selected or the reference pitch is inputted, the setting portion 110 sets to each portion of the tuner apparatus 10 the transposition parameter, score parameter, pitch detecting parameter and reference pitch, those being stored in the storage portion 100 as associated with the musical instrument Identifier. Specifically, the setting portion 110 sets the pitch detecting parameter read from the storage portion 100 to the pitch detecting portion 130 as well as the transposition parameter and score parameter read from the storage portion 100 to the display control portion 160. Further, the setting portion 110 sets the reference pitch data indicating the reference pitch inputted via the GUI screen to the target note specifying portion 140 and calculating portion 150. As described above, the setting portion 110 functions as user interface providing portion that provides a user interface for utilizing the tuner apparatus 10 and read-out portion for reading out from the storage portion 100 various parameters according to the type of the musical instrument inputted via the user interface.

The input portion 120 is, for example, an input terminal, and is connected to the microphone 20. When a tone signal of a performed note collected by the microphone 20 is supplied from the microphone 20, the input portion 120 delivers this tone signal to the pitch detecting portion 130.

The pitch detecting portion 130 performs a pitch detecting process in accordance with a predetermined pitch detecting algorism to the tone signal delivered from the input portion 120, thereby detecting a pitch of the tone signal (i.e., a pitch of the performed note). Thereafter, the pitch detecting portion 130 delivers data (hereinafter referred to as "pitch data") indicating this pitch to the target note specifying portion 140 and calculating portion 150. The configuration of the pitch detecting portion 130 will be explained hereinafter with reference to FIG. 3.

Figure 3:
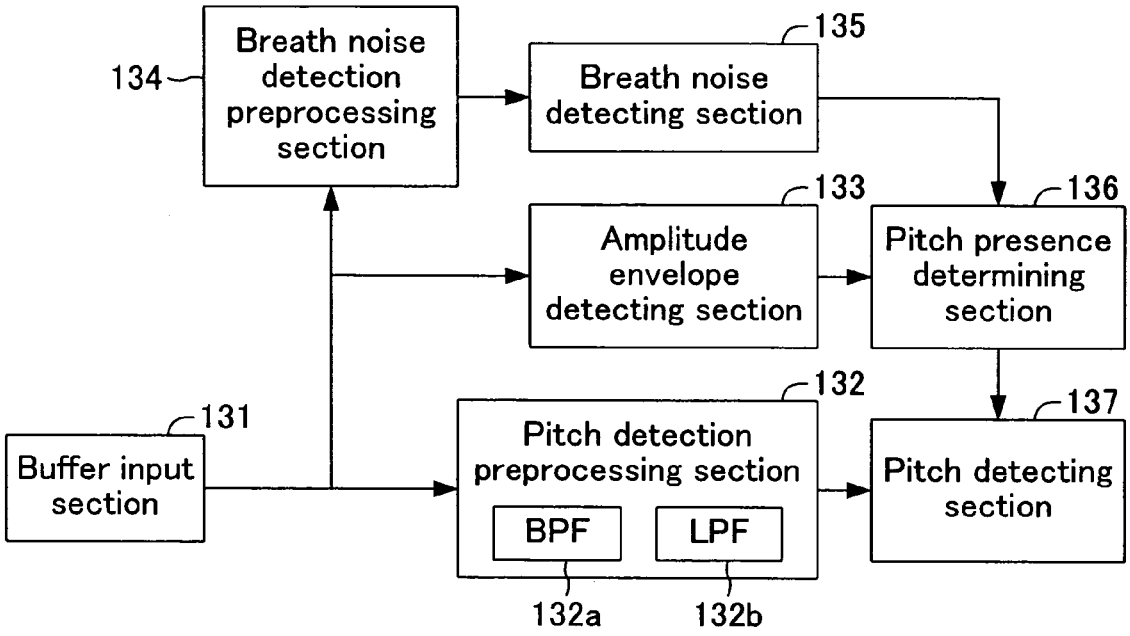
FIG. 3 is a block diagram showing an example of a configuration of a pitch detecting portion 130 in the tuner apparatus 10.

FIG. 3 is a block diagram showing an example of a configuration of the pitch detecting portion 130. As shown in FIG. 3, the pitch detecting portion 130 includes a buffer input section 131, pitch detection preprocessing section 132, amplitude envelope detecting section 133, breath noise detection preprocessing section 134, breath noise detecting section 135, pitch presence determining section 136 and pitch detecting section 137.

The buffer input section 131 samples the tone signal delivered from the input portion 120 at a constant sampling interval (hereinafter referred to as "buffer length"), and then, delivers this sampling result to the pitch detection preprocessing section 132, amplitude envelope detecting section 133 and breath noise detection preprocessing section 134. The buffer length is included in the above-mentioned pitch detecting parameter and is set to the buffer input section 131 by the setting portion 110. In this embodiment, a value of n cycle (n is a lowest periodicity that can detect a pitch) of the lowest pitch that can be performed by the musical instrument to be tuned is set as this buffer length.

The pitch detection preprocessing section 132 in FIG. 3 includes a band path filter (hereinafter referred to as "BPF") 132*a* for limiting frequency range and a low path filter (hereinafter referred to as "LPF") 132*b* that functions as a filter for eliminating higher-harmonic overtones. The BPF 132*a* takes out only a component within a predetermined frequency range from the inputted tone signal and delivers the resultant to the LPF 132*b*. In this embodiment, the aforesaid pitch detecting parameter includes a tone range parameter indicating frequencies of the lowest pitch and highest pitch of each musical instrument as a parameter indicating the frequency range, wherein the frequency range indicating this tone range parameter is set to the BPF 132*a* by the setting portion 110. By setting such frequency range to the BPF 132*a*, a noise unnecessary for the pitch detection is cut from the tone signal delivered from the buffer input section 131, thereby making it possible to enhance reliability in the pitch detection. On the other hand, the LPF 132*b* eliminates a component having a frequency higher than a predetermined cut-off frequency and outputs the resultant. The LPF 132*b* cuts the component of higher-harmonic overtone from the tone signal delivered from the BPF 132*a* and delivers the resultant to the pitch detecting section 137. Note that a parameter indicating whether the use of the LPF 132*b* is allowed or not and the aforesaid cut-off frequency are also included in the pitch detecting parameter. They are set to the LPF 132*b* by the setting portion 110.

The amplitude envelope detecting section 133 in FIG. 3 detects the amplitude envelope of the tone signal delivered from the buffer input section 131, and delivers the data indicating this amplitude envelope to the pitch presence determining section 136.

The breath noise detection preprocessing section 134 in FIG. 3 is, for example, an HPF (High Path Filter). It cuts a component having a frequency lower than the predetermined cut-off frequency from the tone signal delivered from the buffer input section 131, and then, delivers the resultant to the breath noise detecting section 135. On the other hand, the breath noise detecting section 135 determines whether the tone signal delivered from the breath noise detection preprocessing section 134 indicates a breath noise or not. In case where the breath noise detecting section 135 determines that the tone signal is a breath noise, it supplies to the pitch presence determining section 136 a control signal for instructing that the pitch detection based upon this tone signal is not performed. Specifically, in case where the number of times of zero-cross of the inputted tone signal is greater than a predetermined threshold value, the breath noise detecting section 135 determines that the tone, signal indicates the breath noise, and supplies the aforesaid control signal to the pitch presence determining section 136. The pitch detecting parameter includes data indicating whether the breath noise detecting process is performed or not, the above-mentioned predetermined cut-off frequency and the threshold value for the number of times of zero-cross, as a parameter (hereinafter referred to as "breath noise parameter") indicating a breath noise. They are set to the breath noise detection preprocessing section 134 and breath noise detecting section 135 by the setting portion 110. The reason for performing the detection of the breath noise is as follows. Specifically, a pitch may be misdetected by a breath noise at an attack in a wind instrument. In order to avoid the occurrence of such misdetection, the detection of a breath noise is performed.

The pitch presence determining section 136 in FIG. 3 determines whether a pitch is present or not based upon the control signal supplied from the breath noise detecting section 135 and the detecting result of the amplitude envelope detecting section 133. Specifically, in case where the control signal for instructing that the pitch detection is not performed is supplied from the breath noise detecting section 135 or in case where the level of the amplitude envelope detected by the amplitude envelope detecting section 133 is smaller than the predetermined threshold value, the pitch presence determining section 136 determines that there is no pitch, and supplies the control signal indicating this determination to the pitch detecting section 137. On the other hand, the pitch presence determining section 136 determines that there is a pitch in other cases, and supplies the control signal indicating this determination to the pitch detecting section 137. In this embodiment, the predetermined threshold value is included in the pitch detecting parameter as a volume parameter indicating a volume of a musical instrument that is to be tuned. It is set to the pitch presence determining section 136 by the setting portion 110.

In case where the control signal indicating that a pitch is present is supplied from the pitch presence determining section 136, the pitch detecting section 137 in FIG. 3 performs a pitch detecting process in accordance with a predetermined algorithm to the signal waveform delivered from the pitch detection preprocessing section 132, thereby detecting Its pitch.

As described above, the storage portion 100 stores a pitch detecting parameter preferable for performing the pitch detection to the musical instrument for every type of each musical instrument in this embodiment. In the tuner apparatus 10, the pitch detecting parameter corresponding to the type of the musical instrument selected by a user as a musical instrument to be tuned is set to each section of the pitch detecting portion 130, so that the pitch detection can be performed in a preferable manner according to the type of the musical instrument to be tuned. Therefore, the pitch of the performed note can be detected with high precision. When the pitch detection is performed by the pitch detecting portion 130, the pitch data indicating this pitch is delivered to the target note specifying portion 140 and calculating portion 150.

Returning again to FIG. 1, the target note specifying portion 140 specifies a note (hereinafter referred to as "target note") that is positioned nearest to the performed note in a predetermined temperament (e.g., 12-note equal temperament), based upon the reference pitch set by the setting portion 110 and the pitch data delivered from the pitch detecting portion 130, and delivers the data (hereinafter referred to as "target note data") indicating this target note to the calculating portion 150 and the display control portion 160. The explanation is made hereinafter about the case where the target note data is character string data indicating a note name of the target note, but the target note data may be data indicating a pitch of the target note.

The calculating portion 150 calculates a difference between the pitch of the target note specified by the target note specifying portion 140 and the pitch detected by the pitch detecting portion 130, and delivers data (hereinafter referred to as "pitch difference data") indicating this difference to the display control portion 160. More specifically explained, the calculating portion 150 calculates a cent value of the pitch indicated by the pitch data, supposing that the pitch of the note having the note name indicated by the target note data delivered from the target note specifying portion 140 is 0 cent, and delivers the data indicating this cent value to the display control portion 160 as the pitch difference data. In case where the target note data is the data indicating the pitch of the target note, the difference between the pitch indicated by the target note data and the pitch indicated by the pitch data may directly be obtained.

The display control portion 160 controls the display device 30 so as to display the pitch difference between the performed note and the target note, the note name of the target note and octave position. More specifically, the display control portion 160 controls the content of the display of the display device 30 by supplying later-described three types of control signals to the display device 30. The first control signal supplied to the display device 30 from the display control portion 160 is the one for instructing that the value indicated by the pitch difference data delivered from the calculating portion 150 is displayed on an area 250 in FIG. 2 in the form of a virtual meter. Further, the display control portion 160 converts the note name of the target note indicated by the target note data delivered from the target note specifying portion 140 into a note name (hereinafter referred to as "note name in score") written in a score of the target note in accordance with transposition parameter described above. After this conversion, the display control portion 160 supplies to the display device 30 a second control signal instructing that the note name in score is displayed in an area 240 in FIG. 2. The third control signal supplied from the display control portion 160 to the display device 30 is a control signal instructing that a note is written at the octave position corresponding to the note name in score on the staff on which a clef indicated by the score parameter is written, and that the resultant is displayed in an area 260 in FIG. 2. This embodiment explains about the case where the display device 30 is controlled by supplying each of the above-mentioned control signals to the display device 30 from the display control portion 160. However, the display control portion 160 may be controlled to generate image data corresponding to the image that is to be displayed on the display device 30, whereby the content of the display on the display device 30 may be controlled by supplying this image data to the display device 30.

[A-2 Operation]

Subsequently explained with reference to the drawings is an operation, among operations performed by the tuner apparatus 10, that remarkably represents the feature of the invention. The following example of the operation explained hereinafter is made about the case where a musical instrument that is to be tuned is a bass clarinet. In the example of the operation explained hereinafter, the transposition parameter stored in the storage portion 100 as associated with a musical instrument identifier indicating a bass clarinet includes a first parameter indicating that a key of the bass clarinet is "in Bb" and a second parameter indicating that its octave shift is "+1". Further, the clef indicated by the score parameter stored in the storage portion 100 as associated with the musical instrument identifier is "G clef".

[Parameter Setting Operation]

Figure 4:
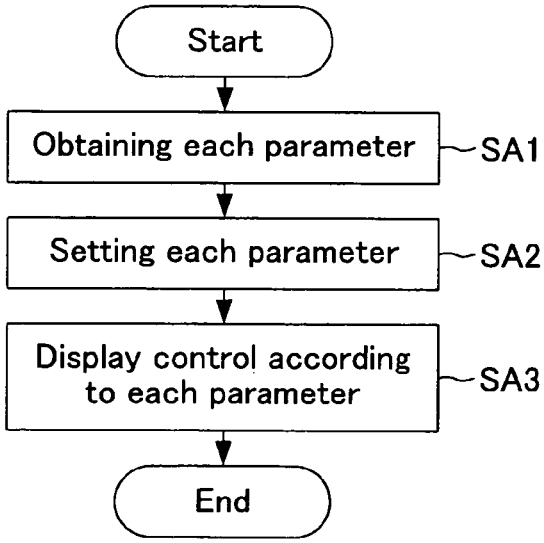
FIG. 4 is a flowchart showing a flow of a parameter setting operation executed by the tuner apparatus 10.

Firstly explained with reference to FIG. 4 is a parameter setting operation for setting various parameters, preferable for the tuning of the bass clarinet, to each portion of the tuner apparatus 10. FIG. 4 is a flowchart showing a flow of the parameter setting operation performed by the tuner apparatus 10. The user visually recognizing the GUI screen shown in FIG. 2 appropriately operates the operating portion (not shown) of the tuner apparatus 10 for inputting numeric character string ("440" in this embodiment) indicating the reference pitch into the area 230, and appropriately operates the pull-down menu 200 for selecting the musical instrument identifier for the bass clarinet that is a musical instrument to be tuned.

Figure 2:
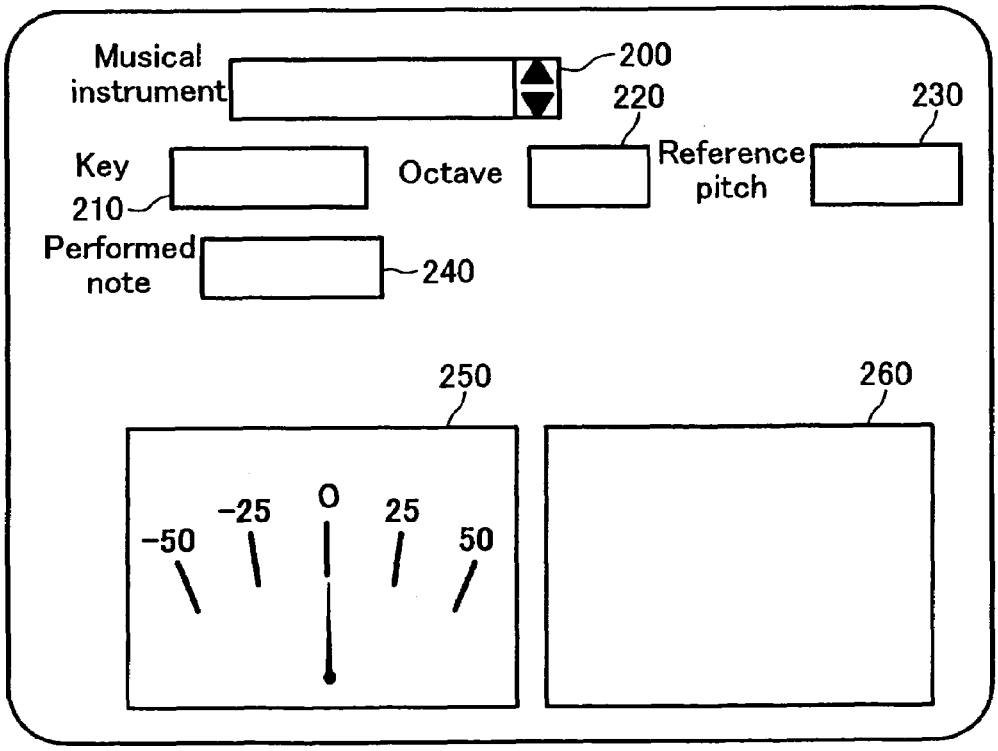
FIG. 2 is a view showing one example of a GUI screen displayed on a display device 30 by the tuner apparatus 10.

When the above-mentioned operation is performed, the setting portion 110 obtains the reference pitch data indicating the reference pitch via the GUI screen shown in FIG. 2, and reads out and obtains the transposition parameter, pitch detecting parameter and score parameter corresponding to the musical instrument identifier selected on the GUI screen from the storage portion 100 (Step SA1). In the example of the operation, the setting portion 110 obtains the numeric value (i.e., 440) indicated by the numeric character string inputted to the area 230 as the reference pitch data, while reads out and obtains the transposition parameter, pitch detecting parameter and score parameter stored in the storage portion 100 as associated with the musical instrument Identifier (i.e., bass clarinet) selected on the pull-down menu 200.

Subsequently, the setting portion 110 delivers various parameters obtained at the Step SA1 to each portion of the tuner apparatus 10, thereby setting these parameters (Step SA2). Specifically, the setting portion 110 sets the reference pitch data obtained at the Step SA1 to the target note specifying portion 140 and calculating portion 150, and sets the pitch detecting parameter obtained at the Step SA1 to the pitch detecting portion 130. Further, the setting portion 110 sets the transposition parameter and the score parameter obtained at the Step SA1 to the display control portion 160.

The display control portion 160 having set thereto the transposition parameter and the score parameter controls the display device 30 so as to display the content according to these parameters onto the GUI screen (Step SA3). Specifically, the display control portion 160 supplies to the display device 30 a control signal for instructing that a key (i.e., "in Bb") indicated by the transposition parameter is displayed onto the area 210 in FIG. 2, and further supplies to the display device 30 a control signal for instructing that the octave shift (i.e., "+1") indicated by the transposition parameter is displayed onto the area 220 in FIG. 2. In addition, the display control portion 160 supplies to the display device 30 a control signal instructing that a staff on which the clef (i.e., "G clef") indicated by the score parameter is written is displayed onto the area 260 in FIG. 2. As a result, the display device 30 displays the GUI screen shown in FIG. 5. Thereafter, the tuner apparatus 10 awaits the input of the tone signal of a performed note via the input portion 120. When the tone signal is inputted, a tuning aid operation explained later is performed. The following explanation is made about the case in which the user blows a note whose note name at the actual tone pitch is "C3" and the tuning is performed for this note.

[Tuning Aid Operation]

Figure 6:
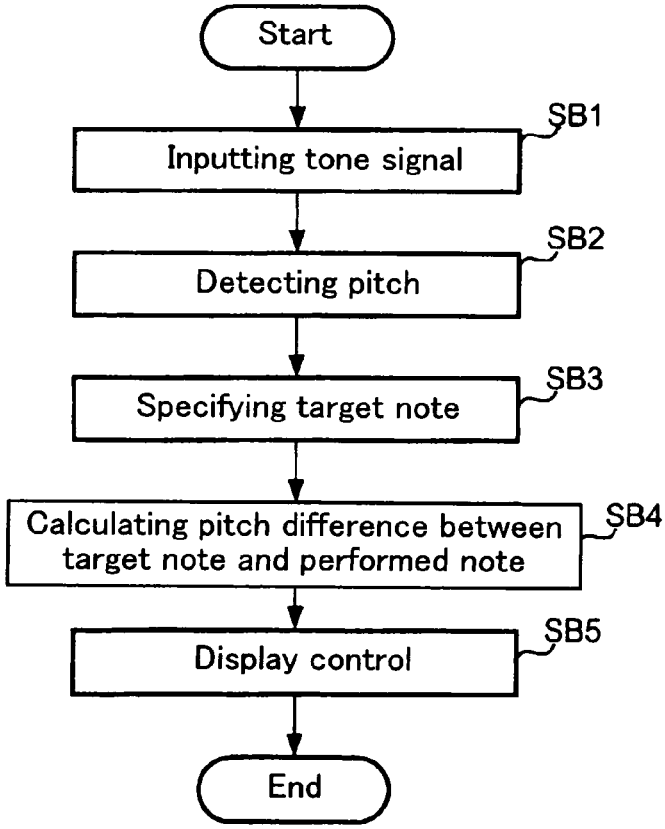
FIG. 6 is a flowchart showing a flow of a tuning aid operation executed by the tuner apparatus 10.

FIG. 6 is a flowchart showing a flow of the tuning aid operation performed by the tuner apparatus 10. As shown in FIG. 6, when the tone signal of the performed note is inputted to the input portion 120 (Step SB1), the tuner apparatus 10 detects the pitch of this tone signal by the pitch detecting portion 130 (Step SB2). Then, the tuner apparatus 10 specifies, by the target note specifying portion 140, a target note that is positioned so as to be nearest to the performed note in a predetermined temperament based upon the pitch detected at the Step SB2 and the reference pitch indicated by the reference pitch data set in the parameter setting operation (Step SB3). In this embodiment, a note having the note name "C3" at the actual tone pitch is specified as the target note, since the tone signal corresponding to the above-mentioned performed note is inputted. The target note specifying portion 140 delivers the target note data (in this embodiment, a character string indicating a note name of the target note at the actual tone pitch) indicating the specified target note to the calculating portion 150 and display control portion 160.

Figure 5:
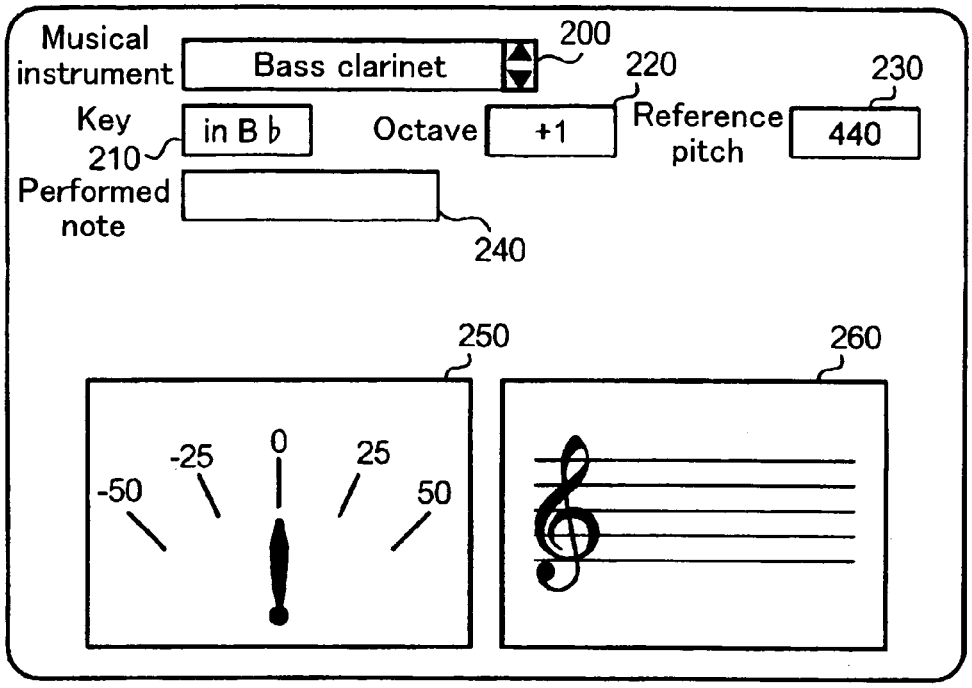
FIG. 5 is a view showing one example of a GUI screen displayed on the display device 30 by the tuner apparatus 10.

Subsequently, the tuner apparatus 10 calculates, by the calculating portion 150, a pitch difference between the target note specified at the Step SB3 and the pitch of the performed note (Step SB4). Then, the tuner apparatus 10 causes, by the display control portion 160, the display device 30 to display the pitch difference calculated at the calculating portion 150, a note name of the target note specified by the target note specifying portion 140 and a note indicating the octave position of the target note (Step SB5). Specifically, the display control portion 160 supplies to the display device 30 a control signal instructing that a pointer of the virtual meter displayed in the area 250 in FIG. 5 is redrawn to the position corresponding to the value indicated by the pitch difference data delivered from the calculating portion 150. Further, the display control portion 160 supplies to the display device 30 a control signal instructing that the note name (i.e., "C3") indicated by the target note data is converted into a note name in score in accordance with the transposition parameter and that the character string indicating the note name in score is displayed onto the area 240 in FIG. 5. In this example of the operation, the note name of the target note is "C3" and the key and octave shift indicated by the transposition parameter are "in Bb" and "+1" respectively, so that the note name of the target note written in a score is "D4". Therefore, the character string "D4" is displayed onto the area 240 in FIG. 5. Then, the display control portion 160 supplies to the display device 30 a control signal instructing that a note corresponding to the note name (i.e., "D4") written in a score is redrawn in the staff displayed on the area 260 in FIG. 5.

Figure 7:
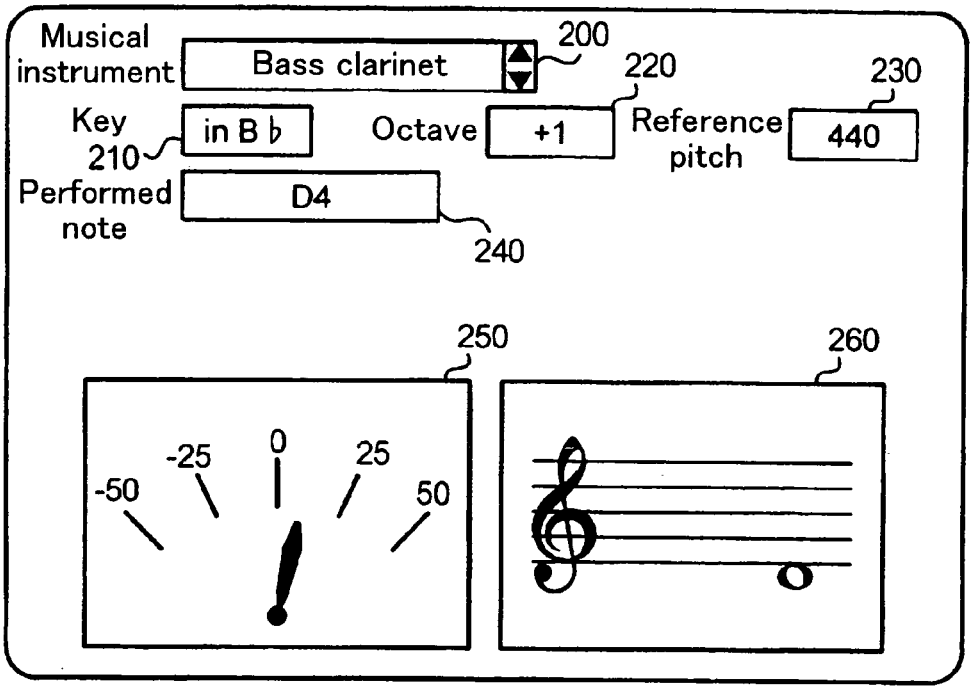
FIG. 7 is a view showing one example of a GUI screen displayed on the display device 30 by the tuner apparatus 10.
Figure 8:
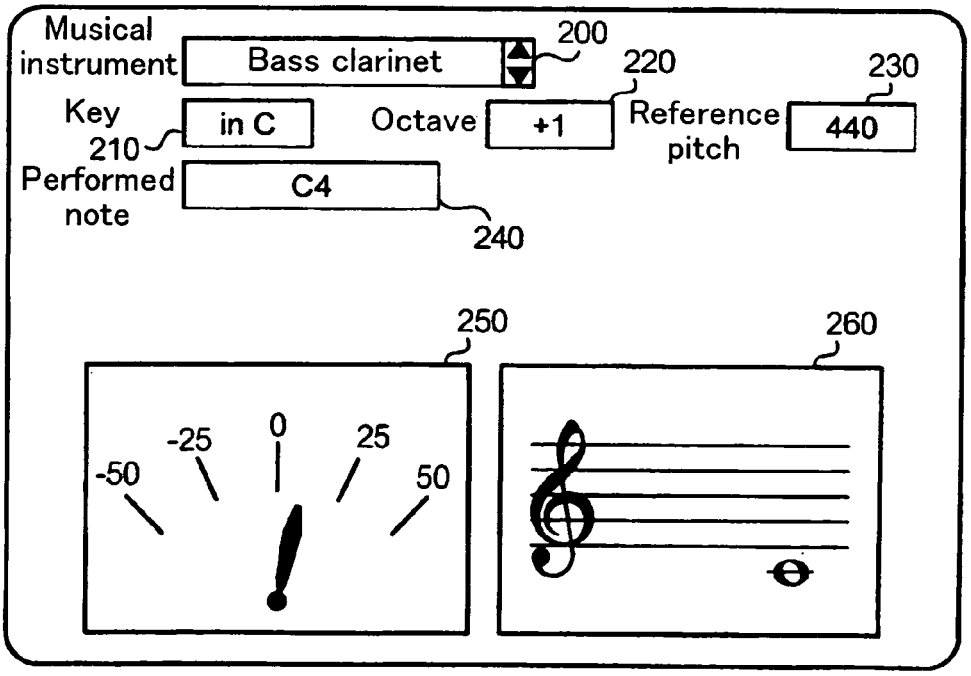
FIG. 8 is a view for explaining an inconvenience in case where a conversion of a key is not performed.
Figure 9:
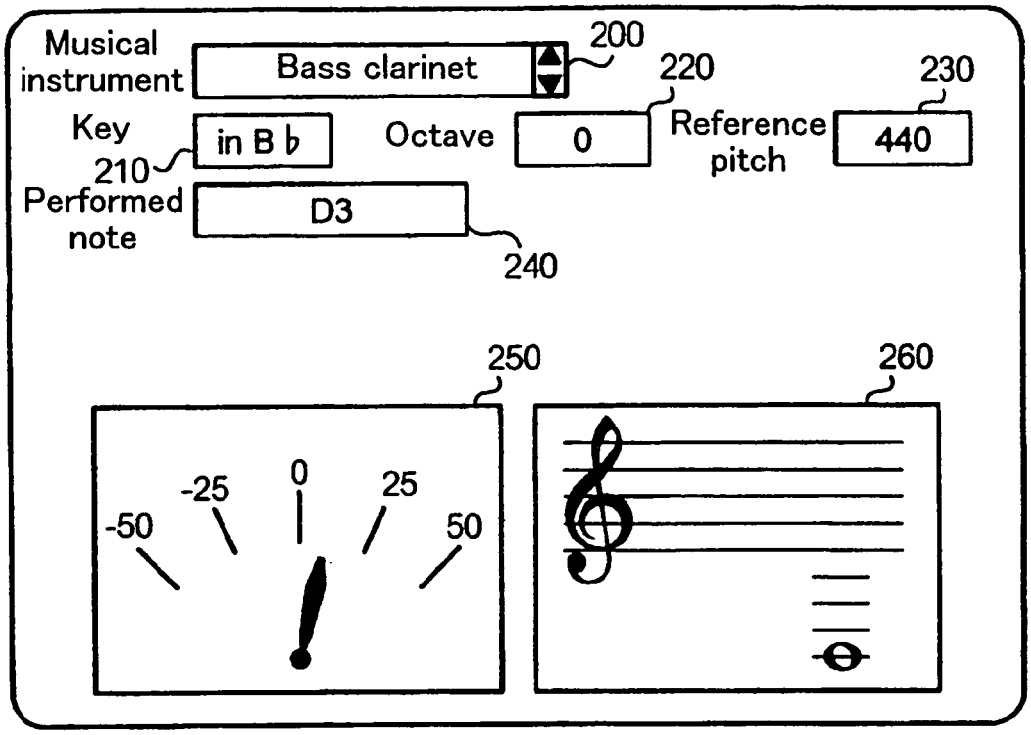
FIG. 9 is a view for explaining an inconvenience in case where an octave shift is not performed.

As a result, the display device 30 displays the GUI screen shown in FIG. 7. The noteworthy points here include that the note name of the target note written in a score is displayed on the area 240, in addition to that the pitch difference between the target note and the performed note is displayed with the use of the meter on the area 250, and that a note corresponding to the note name in score is displayed as written in the staff in the area 260. The bass clarinet has low tone range, so that the transposed score of in Bb in which pitches are shifted one octave higher with a G clef is generally used. In this type of transposed score, the note having a note name of C3 at the actual tone pitch is written as D4. Therefore, if the note name and octave position of the performed note are displayed without performing a key conversion, or alternately, the note name and octave position of the performed note are displayed without performing a conversion of the octave position, the target note are displayed with a note name different from that in a score that is usually utilized by a user who is used to look the aforesaid transposed score (see FIG. 8), or a note is displayed at the position different from that in the aforesaid score (see FIG. 9). Therefore, useless confusion may be entailed, thereby making it impossible to smoothly carry out the tuning operation.

On the other hand, the tuner apparatus 10 according to this embodiment displays the note name of the performed note and its octave position by using a transposition according to a type of a musical instrument that is to be tuned and a score that is usually utilized for this musical instrument as shown in FIG. 7. Therefore, the tuner apparatus 10 according to this embodiment provides an effect that a tuning operation is smoothly performed without causing a user to feel a useless confusion. Further, the tuner apparatus 10 according to this embodiment detects a pitch of a performed note of the musical instrument based upon a pitch detecting parameter according to a type of a musical instrument that is to be tuned, whereby it provides an effect that the detection precision is enhanced and highly precise tuning can be performed.

Second Embodiment

Subsequently, a tuner apparatus 40 according to a second embodiment of the present invention will be explained.

[B-1: Configuration]

Figure 10:
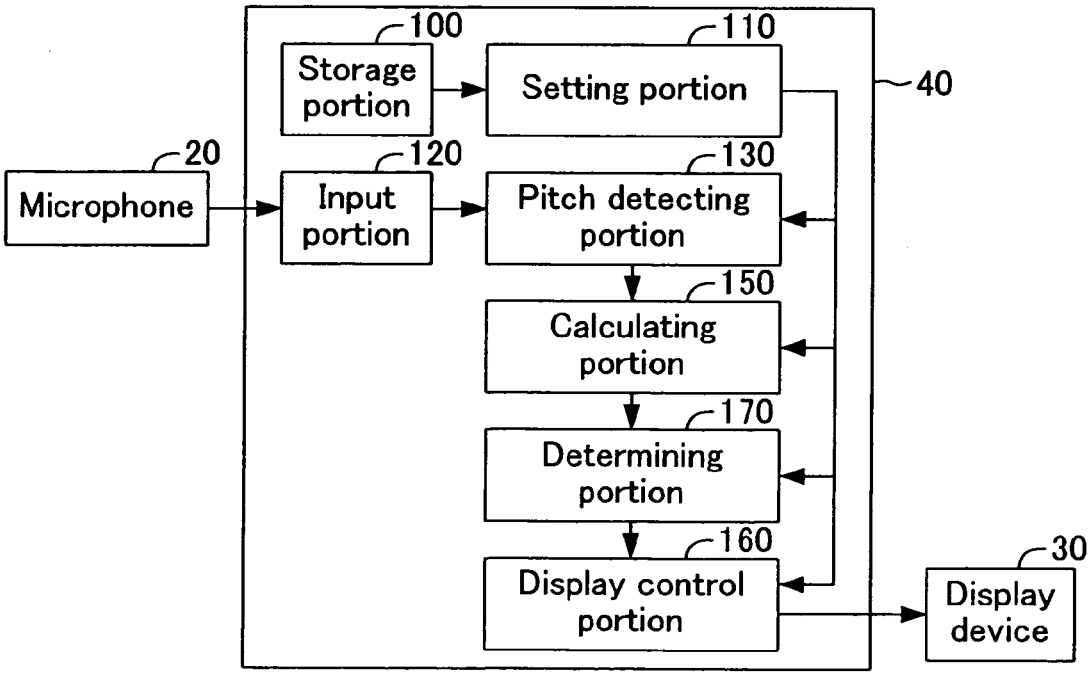
FIG. 10 is a view showing an example of a configuration of a tuner apparatus 40 according to a second embodiment of the present invention.

FIG. 10 is a block diagram showing an example of a configuration of a tuner apparatus 40 according to the second embodiment of the present invention. The different point of the tuner apparatus 40 shown in FIG. 10 from the tuner apparatus 10 (see FIG. 1) are that the target note data indicating a note name of the target note that should be tuned is stored beforehand at the storage portion 100 and that a determining portion 170 is provided instead of the target note specifying portion 140.

In case where the difference between the pitch of the performed note detected by the pitch detecting portion 130 and the pitch of the target note is a value within a predetermined range (for example, −5 cent to +5 cents), the determining portion 170 operates the display control portion 160 to cause the display device 30 to display the difference between both pitches, the note name of the target note and octave position of the target note. This embodiment explains about the case wherein predetermined target note data is stored beforehand in the storage portion 100, but a user may input the target note data to designate the target note. Specifically, an area to which the target note data is inputted by a user is newly provided on the GUI screen shown in FIG. 2, and the target note data inputted to this area may be written into the storage portion 100 by the setting portion 110. Further, a tone output portion for outputting the target note may be provided at the tuner apparatus 40. This makes it possible to get the user grasp the pitch difference between the performed note and the target note with an auditory sense.

[B-2: Operation]

Subsequently explained is an operation, among operations performed by the tuner apparatus 40, that remarkably represents the feature of the invention. The following example of the operation explained hereinafter is made about the case where a character string "C3" is stored beforehand as the target note data in the storage portion 100. Further, the following example of the operation explained hereinafter is made about the case wherein a bass clarinet is tuned, like the first embodiment. The parameter setting operation is the same as that performed by the tuner apparatus 10, so that its detailed explanation is omitted.

Figure 11:
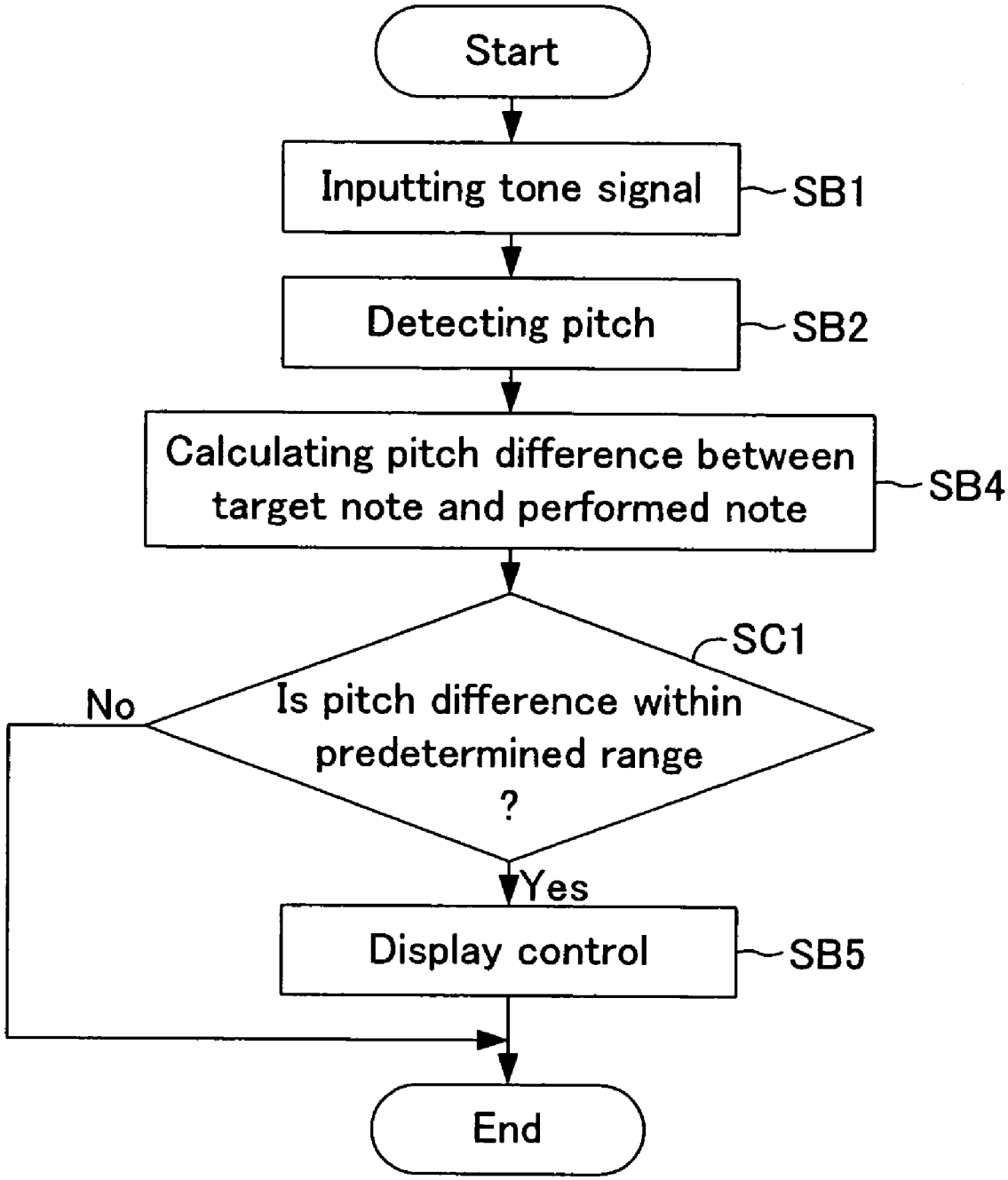
FIG. 11 is a flowchart showing a flow of a tuning aid operation executed by the tuner apparatus 40.

FIG. 11 is a flowchart showing a flow of a tuning aid operation performed by the tuner apparatus 40. The tuning aid operation shown in FIG. 11 is different from that shown in FIG. 6 in the following two points. The first point is that the process at Step SB3 (target note name specifying process) is not performed. This is because the target note data is stored beforehand at the storage portion 100 of the tuner apparatus 40 (i.e., the target note is determined beforehand). The second point is that the tuning aid operation in FIG. 11 has Step SC1 for determining whether the pitch difference calculated at Step SB4 in FIG. 11 is a value within a predetermined range, and only in case where the determination result is affirmative, the process at Step SB5 is performed.

Therefore, only when the difference between the pitch of the performed note and the pitch of the target note designated beforehand is within a predetermined range (for example, −5 cent to +5 cents), the area 250 on the GUI screen shown in FIG. 7 is driven by the display device 30, according to the tuner apparatus 40,of this embodiment.

As described above, the tuner apparatus 40 according to this embodiment can smoothly perform the tuning aid operation without causing useless confusion to the user. In addition, a tuning operation can be performed as a note to be tuned is designated, if a user is caused to designate a target note.

C: Third Embodiment

Subsequently, a tuner apparatus 50 according to the third embodiment of the present invention will be explained.

[C-1: Configuration]

Figure 12:
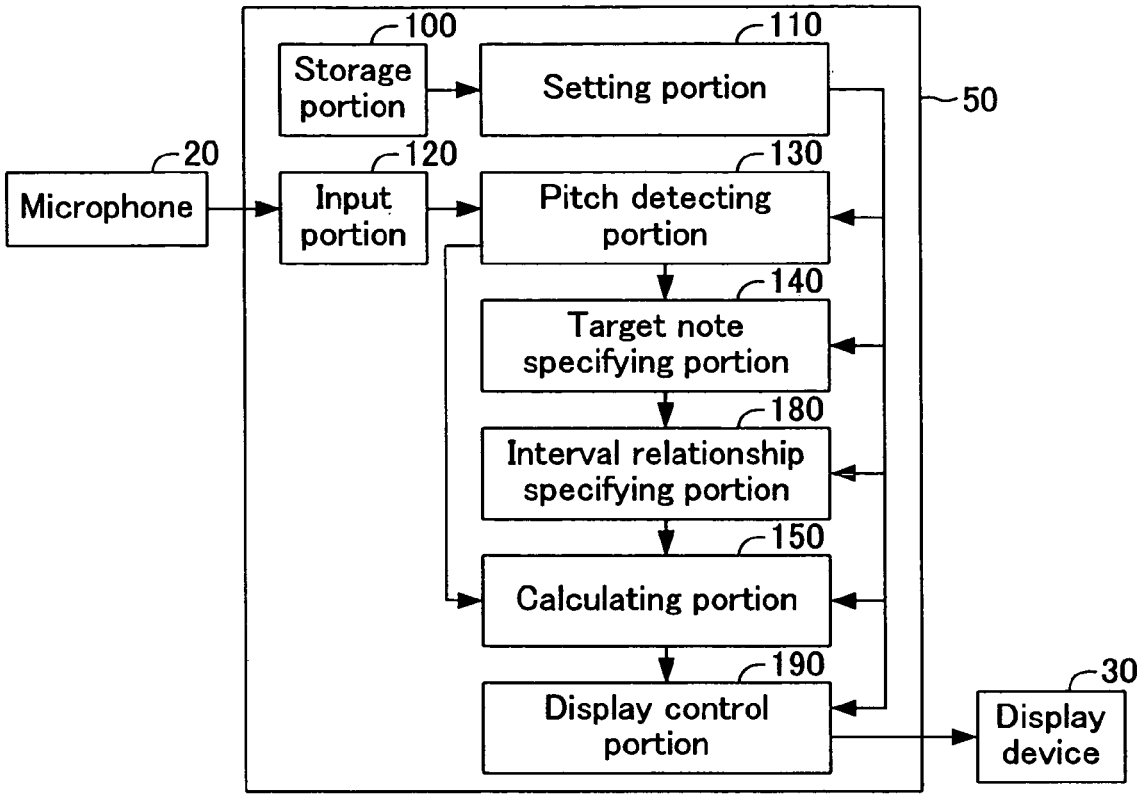
FIG. 12 is a view showing an example of a configuration of a tuner apparatus 50 according to a third embodiment of the present invention.

FIG. 12 is a block diagram showing an example of a configuration of a tuner apparatus 50 according to the third embodiment of the present invention. The tuner apparatus 50 shown in FIG. 12 is different in configuration from the tuner apparatus 10 (see FIG. 1) in that root data indicating a note having a predetermined pitch is stored in the storage portion 100, that an interval relationship specifying portion 180 is newly provided and that a display control portion 190 is provided instead of the display control portion 160. This embodiment explains about the case wherein the root data is stored beforehand in the storage portion 100, but a user may input the root data to designate the root. Specifically, an area to which a user inputs the root data is newly provided on the GUI screen shown in FIG. 2, wherein the root data inputted to this area may be written into the storage portion 100 by the setting portion 110.

The interval relationship specifying portion 180 specifies an interval relationship between the target note specified by the target note specifying portion 140 and the note indicated by the root data. In case where the interval relationship specified by the interval relationship specifying portion 180 is a predetermined interval relationship (for example, harmonics such as minor third, major third, perfect fourth or perfect fifth), the calculating portion 150 and display control portion 190 are driven in the tuner apparatus 50. The following explanation is made about the case wherein the data indicating the predetermined interval relationship is stored beforehand in the storage portion 100, but a user may set the data to set the predetermined interval relationship. In this case wherein the interval relationship is set by the user, the target note specification portion 140 and/or the interval specification portion 180 drive the calculating portion 150 and display control portion 190 based on the root, the standard pitch set by the user and the interval relationship set by the user. In other words, a note, which has the interval relationship set by the user with the root in the predetermined temperament, is specified by the target note specification portion 140 and/or the interval specification portion 180 based on the root, the standard pitch and the interval relationship. Further, this embodiment explains about the case wherein the calculating portion 150 and the display control portion 190 are driven only in case where the predetermined interval relationship is established between the root and the target note. However, the calculating portion 150 and the display control portion 190 may be driven, regardless of whether the predetermined interval relationship is established between the root and the target note.

Figure 13:
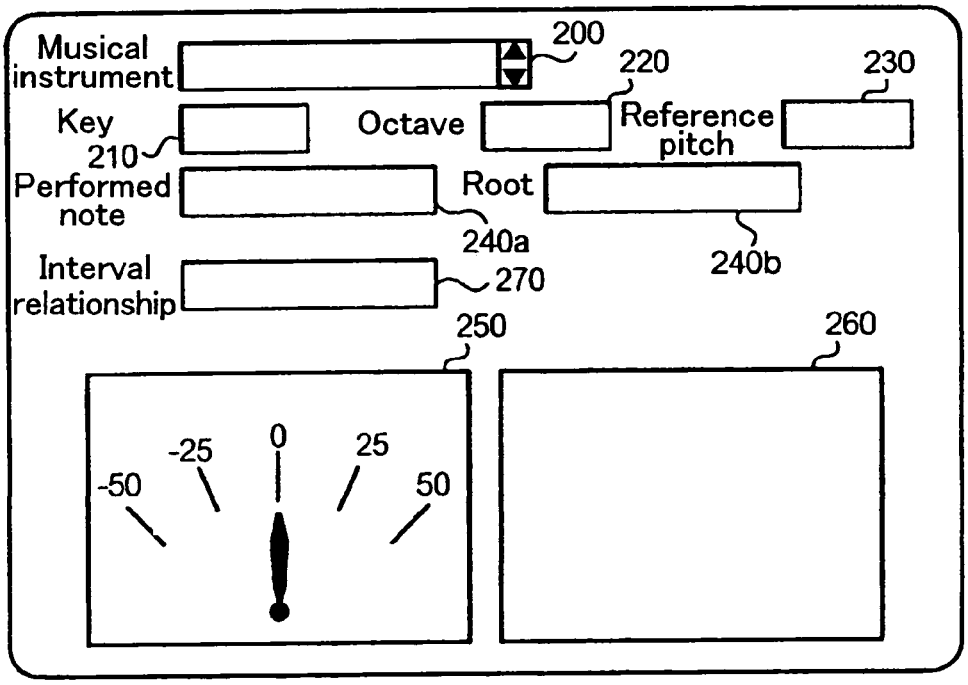
FIG. 13 is a view showing one example of a GUI screen displayed on the display device 30 by the tuner apparatus 50.

The display control portion 190 in FIG. 12 causes the display device 30 to display the GUI screen shown in FIG. 13, thereby displaying on the display device 30 the pitch position of the target note in case where the pitch of the equal temperament interval corresponding to the target note is 0 cent, the pitch difference between the performed note and the target note calculated by the calculating portion 150, character string indicating the interval relationship specified by the interval relationship specifying portion 180 and the octave position of the root and the target note. More specifically explained, the display control portion 190 supplies later-described four types of control signals to the display device 30 for controlling the display content.

The first control signal supplied to the display device 30 by the display control portion 190 is a control signal for instructing that, on the virtual meter displayed on the area 250 in FIG. 13, a predetermined mark is drawn at the pitch position of the target note in case where the pitch of the equal temperament interval corresponding to the target note is 0 cent, and instructing that the pointer of the virtual meter is redrawn at the position corresponding to the pitch difference between the performed note and the target note.

The second control signal supplied to the display device 30 from the display control portion 190 is a control signal instructing that the character string indicating the interval relationship specified by the interval relationship specifying portion 180 is displayed on the area 270 in FIG. 13. The third control signal supplied to the display device 30 from the display control portion 190 is a control signal instructing that the note name of the root written in a score is displayed on the area 240*b* in FIG. 13 and that the note name of the target note written in a score is displayed on the area 240*a* in FIG. 13. The fourth control signal supplied to the display device 30 from the display control portion 190 is a control signal instructing that the note corresponding to the note name of the root written in a score and the note corresponding to the note name of the target-note written in a score are drawn in the staff displayed on the area 260 in FIG. 13.

Figure 14:
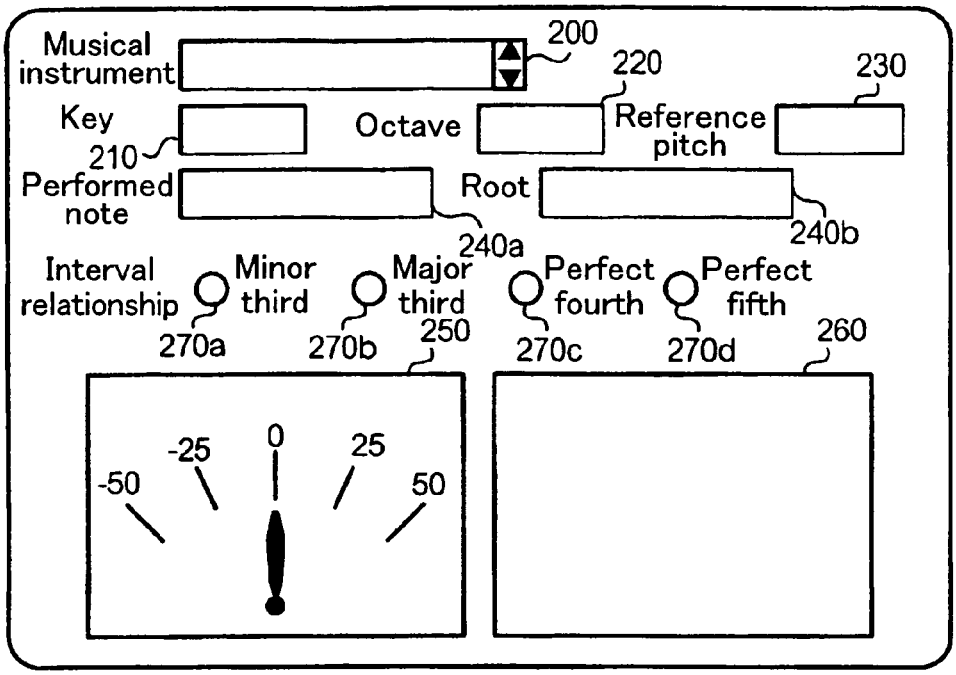
FIG. 14 is a view showing another example of a GUI screen displayed on the display device 30 by the tuner apparatus 50.

Since the tuner apparatus 50 according to this embodiment has the configuration explained above, a user can perform tuning the note (i.e., the note in predetermined harmony with the root), that has a predetermined interval relationship with the root indicated by the root data, defined as the target note. If the tuner apparatus 50 is provided with a sound output portion for outputting the root tone, it becomes possible to practice playing a musical instrument as audibly grasping the interval relationship with this root, i.e., to practice playing harmony. The present embodiment explains about the case wherein, in case where there is a predetermined interval relationship between the root and the target note, the pitch position is informed by displaying the predetermined mark at the pitch position of the target note. However, the pitch position may be informed by lighting an indicator arranged beforehand at the pitch position. Further, as shown in FIG. 14, the GUI screen having arranged thereon indicators each specific to every interval relationship may be displayed by the display device 30, whereby only the indicator corresponding to the interval relationship between the root and the target note may be lighted. For example, in case where the interval relationship between the root and the target note is the perfect fifth, the indicator 270*d* is lighted on the GUI screen in FIG. 14. Moreover, a notification portion (e.g., LED that is lighted when the pitch of the performed note is within the range from −5 cent to +5 cents with the pitch of the target note as a center) may be provided for notifying that the pitch of the performed note is within a predetermined range (e.g., the above-mentioned range) with the pitch of the target note as a center.

[C-2: Operation ]

Subsequently explained with reference to the drawings is an operation, among operations performed by the tuner apparatus 50, which remarkably represents the feature of the invention. The following example of the operation explained hereinafter is made about the case where a flute is used in practicing playing harmony. In the example of the operation explained hereinafter, the transposition parameter stored in the storage portion 100 as associated with a musical instrument identifier indicating a flute indicates that a key of flute is "in C " and its octave shift is "0". Further, the clef indicated by the score parameter stored in the storage portion 100 as associated with the musical instrument identifier is "G clef". Further, the storage portion 100 stores data indicating that the note name of the actual tone pitch is "C4" as the root data.

Figure 15:
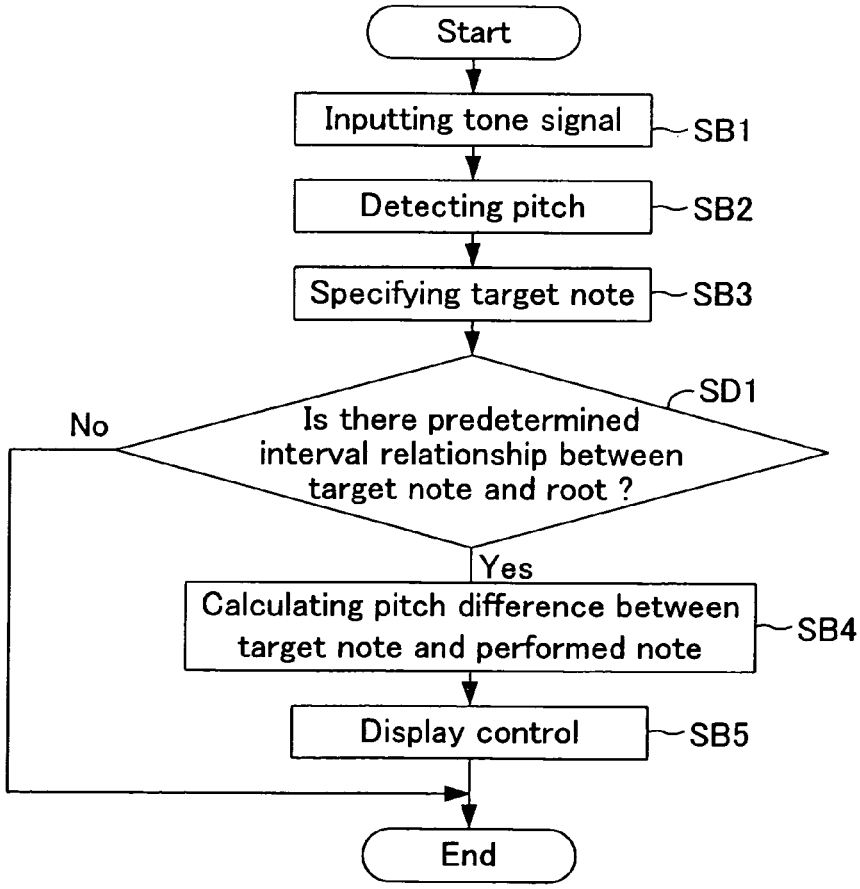
FIG. 15 is a flowchart showing a flow of a harmony lesson aid operation executed by the tuner apparatus 50.

The flow of the parameter setting operation performed by the tuner apparatus 50 is the same as that performed by the tuner apparatus 10, except that the values of the transposition parameter and score parameter are different, so that the detailed explanation is omitted. A harmony lesson aid operation performed by the tuner apparatus 50 will be explained hereinafter. FIG. 15 is a flowchart showing a flow of the harmony lesson aid operation performed by the tuner apparatus 50. The flowchart shown in FIG. 15 is different from that in FIG. 6 in the following point. Specifically, in the flowchart shown in FIG. 15, after specifying the target note at Step SB3, the interval relationship specifying portion 180 specifies the interval relationship between the target note and the note indicated by the root data. Then, it is determined whether the interval relationship is the predetermined interval relationship or not (Step SD1). If the answer is affirmative, the processes after the Step SB4 are executed. At Step SB5 in FIG. 15, the display control portion 190 supplies the aforesaid four control signals to the display device 30 to perform the display control.

Figure 16:
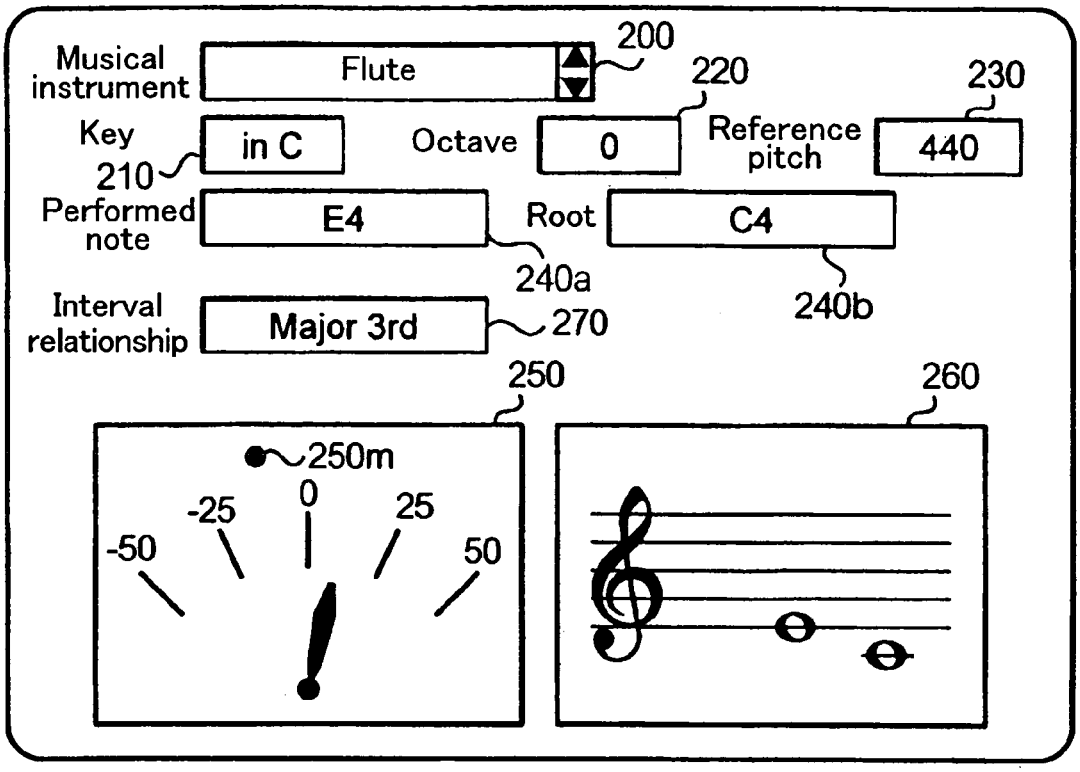
FIG. 16 is a view showing one example of a GUI screen displayed on the display device 30 by the tuner apparatus 50.
Figure 17:
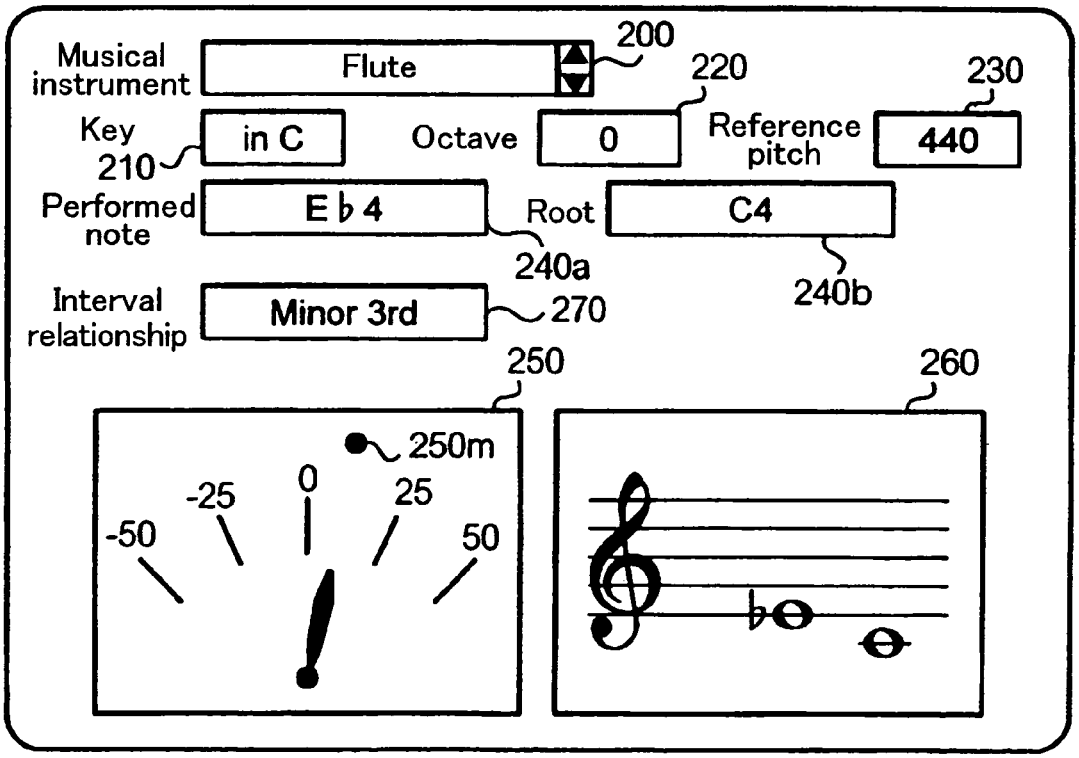
FIG. 17 is a view showing one example of a GUI screen displayed on the display device 30 by the tuner apparatus 50.
Figure 18:
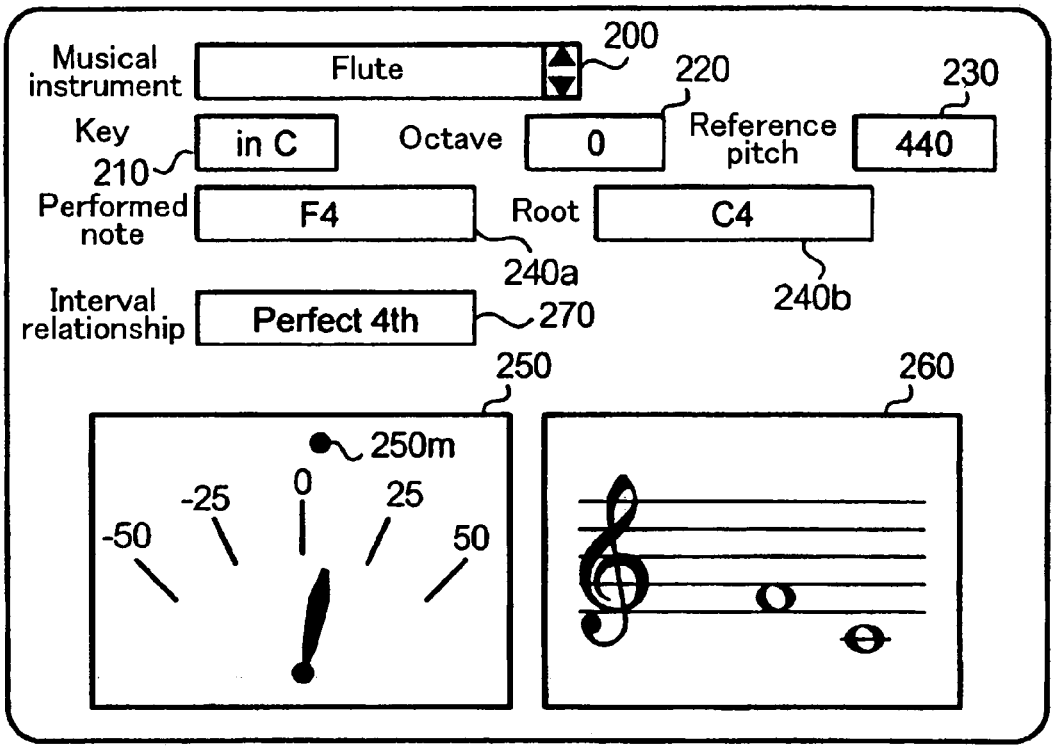
FIG. 18 is a view showing one example of a GUI screen displayed on the display device 30 by the tuner apparatus 50.
Figure 19:
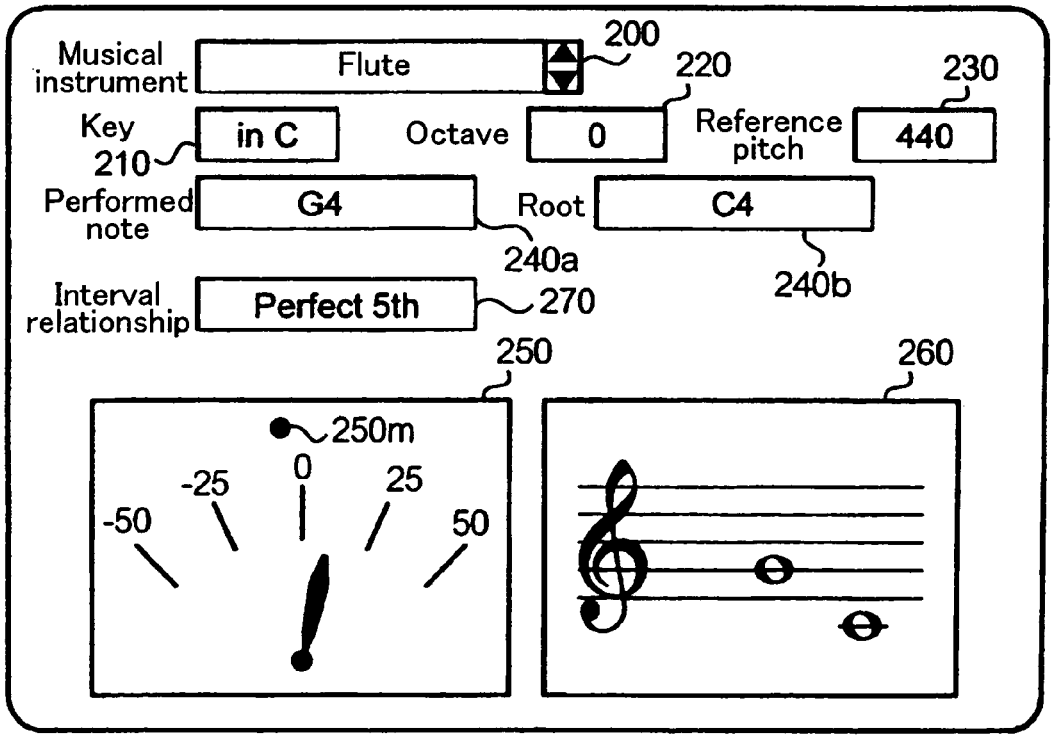
FIG. 19 is a view showing one example of a GUI screen displayed on the display device 30 by the tuner apparatus 60.

For example, in case where the performed note is "E4", this performed note has the interval relation of "major third" (the interval relationship wherein, supposing that the pitch of the latter is 0 cent, the pitch of the former is −13.7 cent: sometimes referred to as "Major 3rd") with the root ("C4"), so that the GUI screen shown in FIG. 16 is displayed on the display device 30. At the area 250 in FIG. 16, a predetermined mark 250*m* is displayed at the pitch position (i.e., the position of −13.7 cent) of the target note, supposing that the pitch of the equal temperament interval corresponding to the target note is 0 cent. Further, in case where the performed note is "Eb4", this performed note has the interval relation of "minor third" (the interval relationship wherein, supposing that the pitch of the latter is 0 cent, the pitch of the former is +15.6 cents: sometimes referred to as "Minor 3rd") with the root, so that the GUI screen shown in FIG. 17 is displayed on the display device 30. In case where the performed note is "F4", this performed note has the interval relation of "perfect fourth" (the interval relationship wherein, supposing that the pitch of the latter is 0 cent, the pitch of the former is −1.95 cent: sometimes referred to as "Perfect 4th") with the root, so that the GUI screen shown in FIG. 18 is displayed on the display device 30. In case where the performed note is "G4", this performed note has the interval relation of "perfect fifth" (the interval relationship wherein, supposing that the pitch of the latter is 0 cent, the pitch of the former is +1.95 cents: sometimes referred to as "Perfect 5th") with the root, so that the GUI screen shown in FIG. 19 is displayed on the display device 30.

Figure 20:
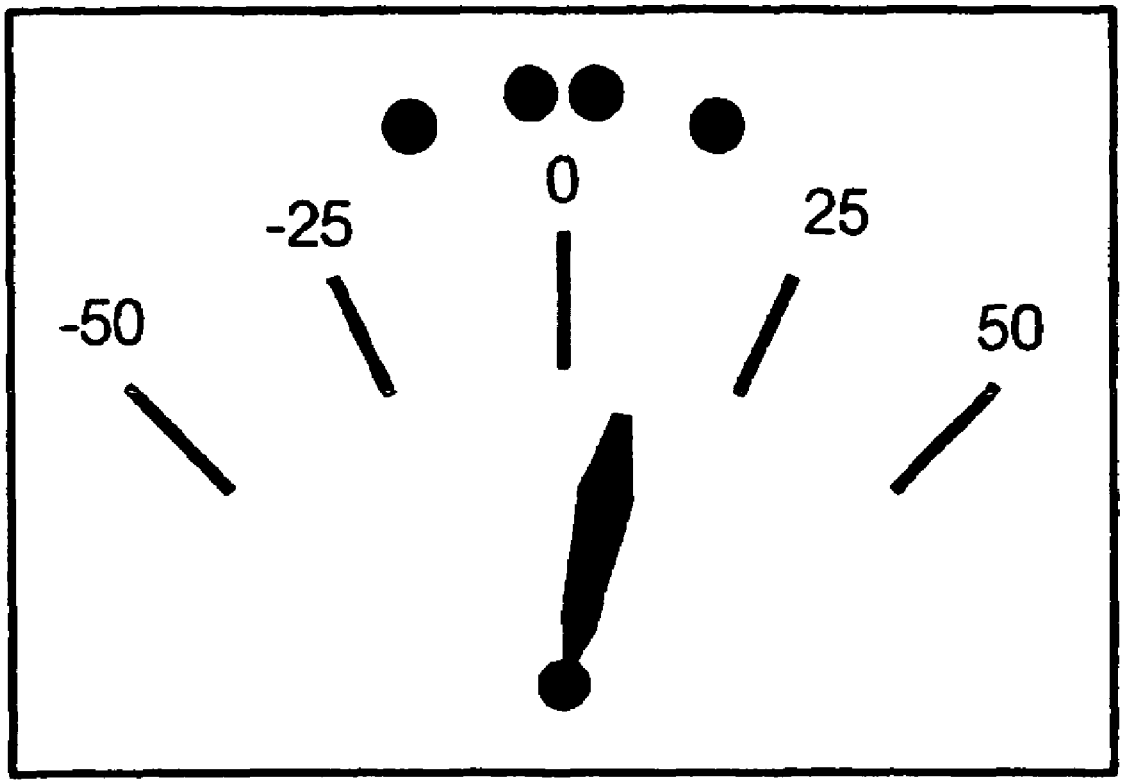
FIG. 20 is a view for explaining an inconvenience of a conventional tuner apparatus for practicing playing harmony.

As described above, only in case where the target note has the predetermined interval relation with the predetermined root, the pitch difference between the performed note and the target note is displayed with the use of a meter, and the character string indicating the aforesaid interval relationship, the pitch position of the equal temperament interval corresponding to the target note and the note name and octave position of both notes written in a score are displayed, according to the tuner apparatus 50 of this embodiment. This allows the user to visually grasp the pitch difference between the performed note and the target note and to visually grasp the harmonic relation between the performed note and the root. As described above, all pitch positions of the notes that are in harmonic relation with the predetermined root are displayed in the conventional tuner apparatus for practicing playing harmony, so that the display content is complicated (see FIG. 20), thereby entailing a problem that each user is difficult to grasp which note having which pitch position should be played. On the other hand, in case where a predetermined interval relationship is established between the performed note and the root (e.g., perfect fourth), the tuner apparatus 50 according to this embodiment displays only the pitch position corresponding to this interval relationship, thereby providing an effect that the complicated display is eliminated and practicing playing harmony is facilitated.

D: MODIFIED EXAMPLE

Each embodiment of the present invention has been explained above. However, the modifications explained below may be added thereto.

[D-1: Modified Example 1]

The above-mentioned each embodiment explains about the case in which the transposition parameter indicating the key or octave shift of this musical instrument is set by selecting the musical instrument identifier indicating a musical instrument to be tuned by a pull-down menu. This provides an effect that the transposition parameter suitable for each musical instrument can conveniently be set. However, the parameter may be independently inputted by a user. Alternately, a rewriting portion may be provided for rewriting each parameter set by a pull-down menu according to a demand of a user. Further, holding portion (e.g., Random Access Memory or the like) for holding the transposition parameter read from the storage portion 100 according to the type of the musical instrument selected by a user may be provided, wherein, in case where a user performs a predetermined operation, the transposition parameter rewritten by the user may be again rewritten with the transposition parameter held at the holding portion for every parameter, such as the parameter indicating the key or the parameter indicating the octave shift. This provides an effect that the transposition parameter can flexibly be set according to a demand of a user.

The above-mentioned each embodiment explains about the case in which the musical instrument identifier indicating a musical instrument to be tuned is selected by appropriately operating a pull-down menu by a user. However, the musical instrument to be tuned may be automatically recognized based upon the performed note of the musical instrument to be tuned, for example. Specifically, the musical instrument identifier and the parameter indicating a feature in the waveform of the performed note of the musical instrument indicated by the musical instrument identifier are stored in the storage portion 100 as associated with each other. Then, the waveform of the performed note inputted to the input portion 120 is analyzed to extract its feature, whereby the musical instrument playing this performed note may be recognized based upon the extracted feature and the storage content in the storage portion 100.

[D-2: Modified Example 2]

The above-mentioned each embodiment explains about the case in which the pitch detecting parameter preferable for each musical instrument, transposition parameter indicating the transposition of each musical instrument and score parameter indicating a score preferable for the musical instrument are stored in the storage portion 100 as associated with the musical instrument identifier indicating a type of the musical instrument. However, in addition to the pitch detecting parameter, transposition parameter and score parameter, a meter displaying parameter for specifying the display manner upon displaying the pitch difference between the target note and the performed note with the use of a meter may be stored in the storage portion 100 as associated with the musical instrument identifier. Examples of the meter display parameter include the detection interval of pitches in the pitch detecting portion 130, data for specifying that no-pitch is displayed on the meter display upon how many times the determination that there is no pitch are continuously made in the pitch presence determining portion 136, whether the history of the pitch detected by the pitch detecting portion 130 is averaged to be displayed on the meter, a method of averaging and a number of history utilized for averaging, whether an interpolation is performed or not so as to smoothly display the change in the pointer position upon renewing the display of the virtual meter or dividing number of the interpolation, or the like. For example, the period of the performed note is long in a bass instrument, so that the detection frequency of a pitch is decreased. Therefore, there is a fear that the change in the pointer position is discontinuous. As for such a bass instrument, the dividing number is increased to be associated with the meter display parameter indicating that the interpolation is performed, whereby the change in the pointer position of the virtual meter can be made smooth.

[D-3: Modified Example 3]

The above-mentioned first and second embodiments explain about the case wherein the note name of the target note that is positioned nearest to the performed note in a predetermined temperament is converted into the note name written in a score and the resultant is displayed. However, a user may decide whether the conversion is performed or not. If there is a setting that the conversion is not performed, the note name of the target note in the actual tone pitch may be displayed. Further, a user may set whether the transposition is performed or not for the display position of the note corresponding to the target note, and this note may be displayed according to the setting content. This provides an effect that the display manner can flexibly be changed according to a demand of a user, such as the note name of the target note is displayed as a note name in the actual tone pitch, while the position of the note on the staff in the area 260 in FIG. 2 corresponds to the note name written in a score. Further, in the third embodiment too, a user may set which note name of the root or target note is displayed, the note name in the actual tone pitch and the note name written in a score, wherein the embodiment may be modified to display in a manner according to its setting content. Alternately, a user may set whether the transposition is performed or not to the note position, wherein the embodiment may be modified to display in a manner according to its setting content.

[D-4: Modified Example 4]

The aforesaid each embodiment explains about the case wherein the score parameter indicating a clef written in the staff displayed on the area is written in the storage portion 100 as associated with the musical instrument Identifier. This makes it possible to display the staff in which the clef suitable for the range of the musical instrument to be tuned is written. However, a staff in which a G clef is always written as a clef may be displayed, or a staff in which an F clef is always written as a clef may be displayed. Specifically, a staff in which a fixed clef is always written may be displayed, not depending upon a type of a musical instrument.

[D-5: Modified Example 5]

The above-mentioned each embodiment explains about the case wherein the pitch difference between the performed note played by the musical instrument to be tuned and the target note is converted into a cent value and the resultant is displayed on the virtual meter. However, the pitch of the performed note and the pitch of the target note may be displayed by a bar graph. Alternately, both pitches and its pitch difference may be displayed by a numeric value. Any one of the display manners may be adopted, so long as they understandably display the pitch difference between the performed note and the target note.

[D-6: Modified Example 6]

The above-mentioned each embodiment explains about the case wherein the tuner apparatus according to each embodiment is composed of each portion that realizes a function intrinsic to the tuner apparatus according to the present invention. However, a software that causes a control portion such as a CPU (Central Processing Unit) to function as each portion is installed in a computer apparatus, wherein the control portion is operated in accordance with the software to give the computer apparatus the same functions as those of the tuner apparatus according to the above-mentioned embodiments. For example, the software is recorded on a computer-readable recording medium such as a CD-ROM (Compact Disk Read Only Memory) or the like and this recording media is distributed, or the software is distributed via an electrical communication line such as the internet. This provides an effect that the software is installed into an ordinary computer apparatus for making this computer function as the tuner apparatus according to the present invention.

What is claimed is:

1. A tuner apparatus comprising:

a storage portion that stores a transposition parameter as associated with identifiers each indicating a type of a musical instrument, the transposition parameter indicating a relationship between a note name in an actual tone pitch and a note name written in a score of a performed note of a musical instrument to be tuned;

a setting portion that reads out the transposition parameter stored in the storage portion as associated with an identifier selected by a user to set the read out transposition parameter;

an input portion for inputting the performed note of the musical instrument;

a pitch detecting portion that detects a pitch of the inputted performed note;

a calculating portion that calculates a difference between a pitch of a target note and the pitch detected by the pitch detecting portion; and a display control portion that causes a display device to display the difference calculated by the calculating portion, while converting the note name of the target note into the note name written in a score in accordance with the transposition parameter read out by the setting portion and causes the display device to display a staff in which a note corresponding to the converted note name written in a score is written.

2. A tuner apparatus according to claim 1, wherein the display control portion causes the display device to display the converted note name of the target note written in a score.

3. A tuner apparatus according to claim 1, wherein the target note is predetermined.

4. A tuner apparatus according to claim 3, wherein the display control portion causes the display device to display the difference calculated by the calculating portion, only when the difference is a value within a predetermined range.

5. A tuner apparatus according to claim 1, wherein the setting portion sets a reference pitch indicating a pitch of a note that is a standard upon tuning the musical instrument, and a target note specifying portion is provided for specifying the target note, that is positioned nearest to the performed note in a predetermined temperament, based upon the pitch detected by the pitch detecting portion and the reference pitch.

6. A tuner apparatus according to claim 5, wherein the setting portion sets a root, and the display control portion converts the note name of the root into the note name written in a score in accordance with the transposition parameter and causes the display device to display the staff in which the note corresponding to the converted note name of the root written in a score is written.

7. A tuner apparatus according to claim 6, wherein the display control portion causes the display device to display the converted note name of the root written in a score.

8. A tuner apparatus according to claim 6, further comprising an interval relationship specifying portion for specifying an interval relationship between the root and the target note, wherein the display control portion causes the display device to display the interval relationship specified by the interval relationship specifying portion.

9. A tuner apparatus according to claim 6, further comprising an interval relationship specifying portion for specifying an interval relationship between the root and the target note, wherein the calculating portion calculates a difference between the pitch of the target note and the pitch detected by the pitch detecting portion, only when the specified interval relationship is a predetermined interval relationship.

10. A tuner apparatus according to claim 6, further comprising an interval relationship specifying portion for specifying an interval relationship between the root and the target note, wherein the display control portion causes the display device to display the difference calculated by the calculating portion, only when the specified interval relationship is a predetermined interval relationship.

11. A tuner apparatus according to claim 1, wherein the storage portion stores, in addition to the transposition parameter, a score parameter indicating a clef written on the staff that is to be displayed by the display portion, as associated with the identifiers, the setting portion reads out, in addition to the transposition parameter stored in the storage portion as associated with the identifier selected by the user, the score parameter stored in the storage portion as associated with the identifier, and the display control portion writes a note, corresponding to the note name of the target note written in a score, on the staff having the clef indicated by the score parameter set by the setting portion, and displays the resultant on the display device.

12. A tuner apparatus according to claim 1, wherein the setting portion causes a user to select which note name of the target note is displayed on the display device, the note name in the actual tone pitch or the note name written in a score, wherein the display control portion causes the display device to display either one of a character string indicating the note name in the actual tone pitch or a character string indicating the note name written in a score, in accordance with the selection by the user.

13. A tuner apparatus according to claim 1, wherein the setting portion provides a user interface for causing a user to select the identifier of the musical instrument to be tuned among the identifiers stored in the storage portion.

14. A tuner apparatus comprising:

a storage portion that stores a transposition parameter as associated with identifiers each indicating a type of a musical instrument;

a setting portion that reads out the transposition parameter stored in the storage portion as associated with an identifier selected by a user to set the read out transposition parameter;

an input portion for inputting the performed note of the musical instrument;

a pitch detecting portion that detects a pitch of the inputted performed note;

a calculating portion that calculates a difference between a pitch of a target note and the pitch detected by the pitch detecting portion; and a display control portion that causes a display device to display the difference calculated by the calculating portion, while converting the note name of the target note into the note name written in a score in accordance with the transposition parameter read out by the setting portion and causes the display device to display a staff in which a note corresponding to the converted note name written in a score is written, wherein the setting portion provides a user interface for causing a user to select the identifier of the musical instrument to be tuned among the identifiers stored in the storage portion, and reads out the transposition parameter stored in the storage portion as associated with the identifier selected via the user interface, and the display control portion converts the note name of the target note into the note name written in a score in accordance with the transposition parameter read out by the setting portion.

15. A tuner apparatus comprising:

a storage portion that stores a transposition parameter as associated with identifiers each indicating a type of a musical instrument, the transposition parameter indicating a relationship between a note name in an actual tone pitch and a note name written in a score of a performed note of a musical instrument to be tuned;

a setting portion that reads out the transposition parameter stored in the storage section portion as associated with an identifier selected by a user to set the read out transposition parameter;

an input portion for inputting the performed note of the musical instrument;

a pitch detecting portion that detects a pitch of the inputted performed note;

a target note specifying portion for specifying a target note, that is positioned nearest to the performed note in a predetermined temperament, based upon the pitch detected by the pitch detecting portion and the reference pitch;

an interval relationship specifying portion for specifying the interval relationship between the root and the target note; and a display control portion that causes a display device to display the interval relationship specified by the interval relationship specifying portion, while converting the note names of the root and the target note into the note names written in a score in accordance with the transposition parameter read out by the setting portion and causes the display device to display a staff in which notes corresponding to the converted note names of the root and the target note written in a score is written.

16. A tuner apparatus according to claim 15, wherein the display control portion causes the display device to display the converted note name of the target note written in a score.

17. A tuner apparatus comprising:

a storage portion that stores, a transposition parameter as associated with identifiers each indicating a type of a musical instrument, and for every type of musical instrument, a pitch detecting parameter used upon detecting a pitch of a performed note of the musical instrument, wherein the transposition parameter indicates a relationship between a note name in an actual tone pitch and a note name written in a score of a performed note of a musical instrument to be tuned;

a read-out portion that reads out from the storage portion the pitch detecting parameter according to the type of the musical instrument to be tuned and the transposition parameter as associated with an identifier selected by a user;

an input portion that inputs the performed note of the musical instrument; a pitch detecting portion that detects the pitch of the performed note considering the pitch detecting parameter; and a display control portion that causes a display device to display information relating to the pitch detected by the pitch detecting portion.

18. A tuner apparatus according to claim 17, wherein the pitch detecting parameter includes a tone range parameter indicating a tone range of the corresponding musical instrument, and the pitch detecting portion extracts from the inputted performed note a frequency component included in the tone range indicated by the tone range parameter and detects the pitch of the inputted performed note based upon the extracted frequency component.

19. A tuner apparatus according to claim 17, wherein the pitch detecting parameter includes a breath noise parameter indicating a breath noise of the corresponding musical instrument, wherein the pitch detecting portion determines whether the inputted performed note is a breath noise or not based upon the breath noise parameter and detects the inputted performed note in a case where it determines that the inputted performed note is not a breath noise.

20. A tuner apparatus according to claim 17, wherein the pitch detecting parameter includes a volume parameter indicating a threshold value relating to a volume of the corresponding musical instrument, and the pitch detecting portion detects the pitch of the inputted performed note in case where the volume of the inputted performed note is greater than the threshold value indicated by the volume parameter.

21. A tuner apparatus comprising:

a storage portion that stores for every type of musical instrument, a pitch detecting parameter used upon detecting a pitch of a performed note of the musical instrument;

a read-out portion that reads out from the storage portion the pitch detecting parameter according to the type of the musical instrument to be tuned;

an input portion that inputs the performed note of the musical instrument; a pitch detecting portion that detects the pitch of the performed note considering the pitch detecting parameter; and a display control portion that causes a display device to display information relating to the pitch detected by the pitch detecting portion, wherein the pitch detecting parameter includes a volume parameter indicating a threshold value relating to a volume of the corresponding musical instrument, and the pitch detecting portion detects the pitch of the inputted performed note in a case where the volume of the inputted performed note is greater than the threshold value indicated by the volume parameter.

22. A computer-readable medium having encoded thereon a computer program including instructions applied to a tuning apparatus provided with a computer, which when executed cause:

setting a transposition parameter stored in a storage section portion that stores a transposition parameter as associated with identifiers each indicating a type of a musical instrument, the transposition parameter indicating a relationship between a note name in an actual tone pitch and a note name written in a score of a performed note of a musical instrument to be tuned as associated with an identifier selected by a user to set the read out transposition parameter;

inputting the performed note of the musical instrument;

detecting a pitch of the inputted performed note;

calculating a difference between a pitch of a target note and the detected detecting; and displaying the difference calculated by the calculating step, while converting the note name of the target note into the note name written in a score in accordance with the transposition parameter and displaying a staff in which a note corresponding to the converted note name written in a score is written.

23. A computer-readable medium according to claim 22, further causing setting a reference pitch indicating a pitch of a note that is a standard upon tuning the musical instrument, and specifying the target note, that is positioned nearest to the performed note in a predetermined temperament, based upon the detected pitch and the reference pitch.

24. A computer-readable medium according to claim 23, further causing setting a root, and converting the note name of the root into the note name written in a score in accordance with the transposition parameter and displaying the staff in which the note corresponding to the converted note name of the root written in a score is written.

25. A computer-readable medium according to claim 24, further including:

specifying an interval relationship between the root and the target note, and displaying the specified interval relationship.

26. A computer-readable medium having encoded thereon a computer program including instructions applied to a tuning apparatus provided with a computer, which when executed cause:

setting a transposition parameter stored in a storage section portion that stores a transposition parameter as associated with identifiers each indicating a type of a musical instrument, the transposition parameter indicating a relationship between a note name in an actual tone pitch and a note name written in a score of a performed note of a musical instrument to be tuned as associated with an identifier selected by a user to set the read out transposition parameter indicating a relationship between a note name in an actual tone pitch and a note name written in a score of a performed note of a musical instrument to be tuned, a reference pitch indicating a pitch of a note that is a standard upon tuning the musical instrument and a root;

inputting the performed note of the musical instrument;

detecting a pitch of the inputted performed note;

specifying a target note, that is positioned nearest to the performed note in a predetermined temperament, based upon the pitch detected and the reference pitch;

specifying an interval relationship between the root and the target note; and displaying the specified interval relationship, while converting the note names of the root and the target note into the note names written in a score in accordance with the transposition parameter and displaying a staff in which notes corresponding to the converted note names of the root and the target note written in a score is written.

27. A computer-readable medium having encoded thereon a computer program including instructions applied to a tuning apparatus provided with a computer, which when executed cause:

reading out, from a storage portion that stores a transposition parameter as associated with identifiers each indicating a type of a musical instrument, and for every type of musical instrument, a pitch detecting parameter used upon detecting a pitch of a performed note of the musical instrument, the pitch detecting parameter according to the type of the musical instrument to be tuned, wherein the transposition parameter indicates a relationship between a note name in an actual tone pitch and a note name written in a score of a performed note of a musical instrument to be tuned;

inputting the performed note of the musical instrument;

detecting the pitch of the performed note considering the pitch detecting parameter; and displaying information relating to the detected pitch.

* * * * *